US005273224A

United States Patent [19]

Nakagawa et al.

[11] Patent Number: 5,273,224

[45] Date of Patent: Dec. 28, 1993

[54] DOFFING METHOD AND PAPER TUBE SUPPLY SYSTEM FOR AN AUTOMATIC WINDER

[75] Inventors: Osamu Nakagawa, Kyoto; Tomonari Ikemoto; Hideyuki Oe, both of Uji, all of Japan

[73] Assignee: Murata Kikai Kabushiki Kaisha, Kyoto, Japan

[21] Appl. No.: 889,183

[22] Filed: May 27, 1992

[30] Foreign Application Priority Data

May 28, 1991 [JP] Japan ..... 3-123809
Jul. 1, 1991 [JP] Japan ..... 3-188164
Jul. 1, 1991 [JP] Japan ..... 3-188165

[51] Int. Cl.[5] ..... B65H 54/26; B65H 67/06
[52] U.S. Cl. ..... 242/35.5 A
[58] Field of Search ..... 242/35.5 A, 35.5 R

[56] References Cited

U.S. PATENT DOCUMENTS 4,066,218 1/1978 Kamp ..... 242/35.5 A
4,655,665 4/1987 Lattion ..... 242/35.5 A X
4,688,735 8/1987 Shinji et al. ..... 242/35.5 A
4,772,171 9/1988 Mayer et al. ..... 242/35.5 A X
4,865,260 9/1989 Colli et al. ..... 242/35.5 A

FOREIGN PATENT DOCUMENTS 2131957 2/1973 Fed. Rep. of Germany ..... 242/35.5 A
61275 5/1981 Japan ..... 242/35.5 A

*Primary Examiner*—Stanley N. Gilreath
*Attorney, Agent, or Firm*—Spensley Horn Jubas & Lubitz

[57] ABSTRACT

On an automatic winder, at the time of doffing, a signal is sent from a doffing device to a winding unit, a drum motor of the winding unit is driven at a low speed in response to said signal to rotate a package on a traverse drum, and a bobbin yarn is picked up. The automatic winder has a number of winding units juxtaposed, the doffing device is provided to freely travel along the winding units a paper tube supply system for delivering one or more kinds of paper tubes is installed at one end of the automatic winder, a conveyor for carrying paper tubes from the paper tube supply system is provided parallel with a travel path of the doffing device, and a paper tube holding device for receiving paper tubes carried by the conveyor is provided on the doffing device.

5 Claims, 21 Drawing Sheets

DOFFING METHOD AND PAPER TUBE SUPPLY SYSTEM FOR AN AUTOMATIC WINDER

BACKGROUND OF THE INVENTION

1. Field of the Invention

The present invention relates to a doffing method and an automated paper tube supply system which can supply paper tubes of desired kinds to an automatic winder having a number of winding units juxaposed or an automatic winder divided into spans of two kinds or more.

2. Prior Art

First, a conventional paper tube supply system in an automatic winder will be described with reference to FIG. 9. Reference numeral 1 designates a frame for an automatic winder; 2 winding units installed in parallel on the frame 1; 3 a paper tube box; 4 a discharge conveyor installed along the back surface of the automatic winder; 5 a rail installed above the automatic winder; and 6 a doffing device which can travel along the automatic winder on the rail 5. This doffing device carries out a series of the following operations. When a specific winding unit 2 terminates to wind a package P, unwinding stops and a lamp 11 is lit. The doffing device 6 detects lighting of the lamp 11 and stops before a spindle thereof. Then, a yarn Y is picked up. Subsequently, a cutter cuts the yarn Y and holds a lower yarn. Next, a cradle arm 10 is opened to discharge the package P onto the discharge conveyor 4. Then, a paper tube 13 is gripped from the box 3 to carry it to the cradle arm 10. The yarn Y is sandwiched between a paper tube and the cradle arm 10, and the sandwiched yarn Y is moved to a bunch winding position to effect the bunch winding. A button 12 is depressed to start the winding unit 2.

As described above, a conventional paper tube supply is carried out every spindle, and a paper tube supply to the box is carried out by an operator. In the case where there are two or more kinds, an operator replenishes paper tubes to the box 3 while sorting the various kinds of paper tubes.

In the aforementioned conventional paper tube supply system, there is a limitation of the number of paper tubes 13 which can be accommodated in the paper tube box 3 of each spindle (about four paper tubes). Therefore, it is necessary to always monitor the state of the paper tube box 3 to replenish paper tubes corresponding to the kinds to the paper tube box, giving rise to a problem in that labor is required.

In an automatic winder, when a yarn end is, subjected to selvedge winding, the yarn end is wound close to the package (as shown for example, in FIG. 18). Therefore, this prevents the yarn end from being disengaged from the bobbin at the time of winding or at the time of termination of winding. However, subjecting a bobbin to selvedge winding of a yarn end as in the conventional doffing method may cause the falling or dropping of a yarn from an end of the package and may result in an undesirable lease disturbance on the package surface at the time of doffing.

OBJECT AND SUMMARY OF THE INVENTION

An object of the present invention is to provide a paper tube supply system to an automatic winder which can automate a supply of paper tubes and can easily respond to a variety of kinds. Another object of the present invention is to provide a method for controlling a doffing device for stopping a doffing device capable of reciprocatingly travelling along a spinning machine having a number of units arranged in parallel in front of a unit which requires doffing to effect doffing.

Still another object of the present invention is to provide a doffing method for an automatic winder which can pickup a bobbin yarn without occurrence of a lease disturbance in a package surface.

A paper tube supply system according to the present invention comprises two or more paper tube supply devices provided with a paper tube storage portion, a paper tube pull-out portion and a paper tube delivery portion, and one paper tube conveyor connected to said two or more paper tube supply devices and provided along an automatic winder having a number of winding units juxtaposed.

A paper tube of a specific kind requested by an automatic winder is pulled out of two or more paper tube supply devices which store therein a variety of different kinds of paper tubes, and the paper tube is supplied to a paper tube conveyor and carried to a winding unit for which doffing is requested via the paper tube conveyor.

According to a method for controlling a doffing device, a central control device into which a position of a unit requiring doffing is inputted is provided, a descrimination means for present position for a unit is provided on the doffing device, an output of said discrimination means is inputted into the central control device, and a travel direction is directed at the doffing device by the central control device on the basis of a comparison between the position of a unit requiring doffing and the present position of the doffing device in the central control device.

A present position discrimination means is provided on a doffing device to communicate with a central control device into which a unit requiring doffing is inputted, whereby a direction to a unit requiring doffing is directed at the doffing device from the central device so that the doffing device travels in a direction close to the unit.

Furthermore, the present invention provides a doffing method for an automatic winder wherein at the time of doffing, a signal is sent from a doffing carriage to a winding unit, a drum motor of the winding unit is driven at a low speed in response to said signal to rotate a package on a traverse drum, and a bobbin yarn is picked up.

When a bobbin yarn is picked up, rotation of a package by a bunch roller in prior art is not carried out but a drum motor is driven at a low speed to rotate a package. Therefore, a package caused by the bunch roller in prior art is prevented from being damaged. Further, it is possible to positively rotate a package to pickup a bobbin yarn without being affected by the size of package, kinds of yarns, the way of winding, etc.

DETAILED DESCRIPTION OF PREFERRED EMBODIMENTS

Figure 1A:
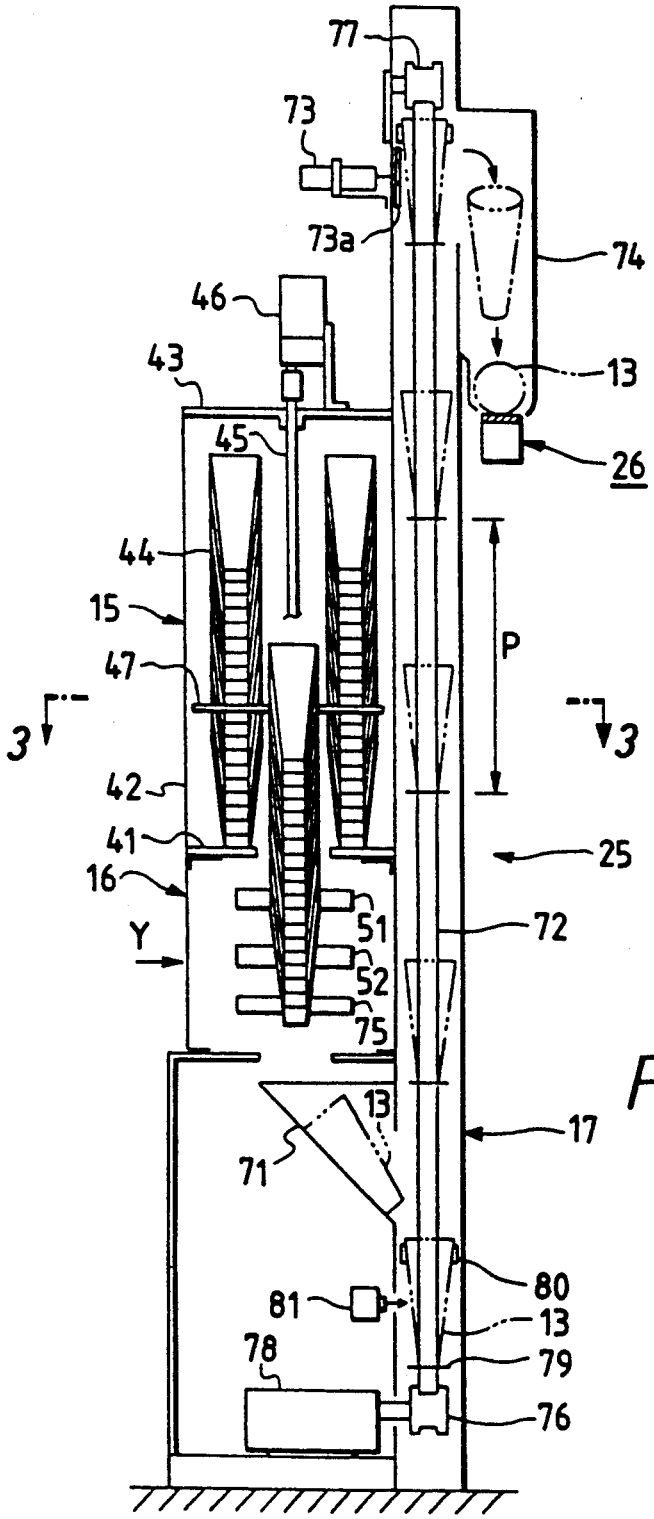
FIG. 1*a* is a side view of a paper tube supply device and a paper tube conveyor.
Figure 1B:
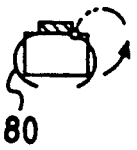
FIG. 1*b* is a detailed view of a guide.
Figure 2:
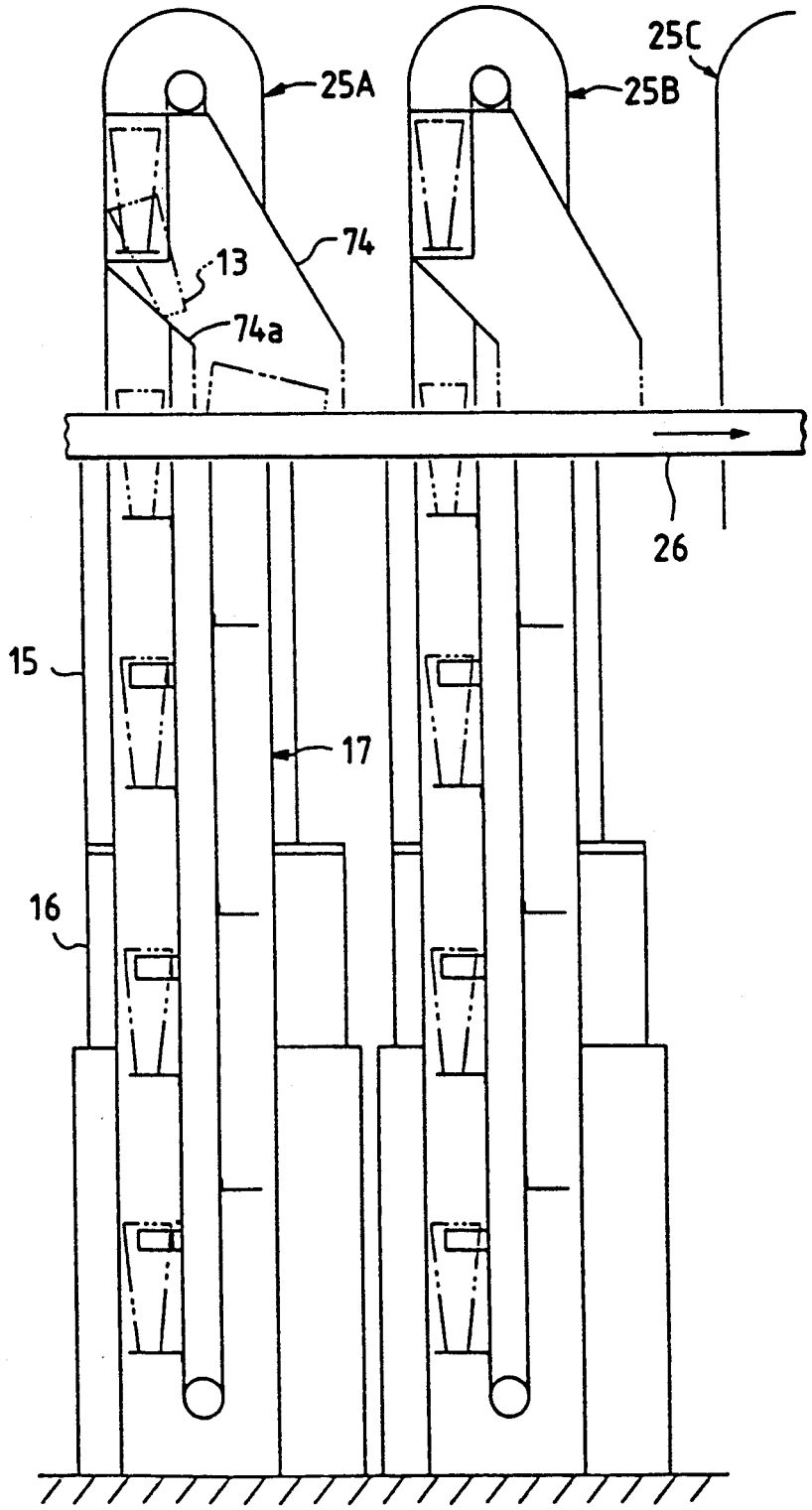
FIG. 2 is a front view of a paper tube supply device and a paper tube conveyor.

An embodiment of the present invention will be described with reference to the drawings. FIG. 1 is a side view of a paper tube supply device and a paper tube conveyor, and FIG. 2 is a front view of a paper tube supply device and a paper tube conveyor.

In FIG. 1, a paper tube supply device 25 comprises a paper tube storage portion 15, a paper tube pull-out portion 16 and a paper tube delivery portion 17. In FIG. 2, three sets of paper tube supply devices 25*a*, 25B and 25C for handling three kinds of paper tubes are connected to one paper tube conveyor 26.

Figure 3:
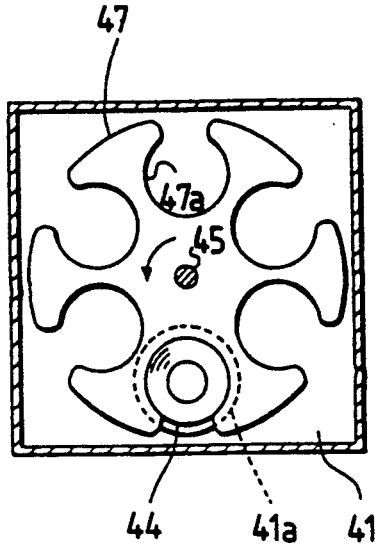
FIG. 3 is a sectional view taken on 3—3 of FIG. 1.

In FIG. 1, the paper tube storage portion 15 accommodates therein a group of a large number of stacked paper tubes 44 in a container comprising a bottom plate 41, a square cylinder 42 and a top plate 43. A shaft 45 is supported rotatably by a geared motor 46 between the top plate 43 and the bottom plate 41, and a holding plate 47 is secured to the shaft. As shown in FIG. 3, the holding plate 47 has six holes 47*a*, into which are inserted a group of paper tubes 44. The bottom plate 41 is bored with one hole 41*a*, from which the group of paper tubes 44 are successively pulled out. When the group of paper tubes 44 are absent in that portion, the holding plate 47 is rotated by 60°, and a new group of paper tubes 44 adjacent thereto assumes a position immediately above the hole 41*a*. In this manner, the paper tube storage portion 15 efficiently stores six sets of a group of stacked paper tubes.

Figure 4:
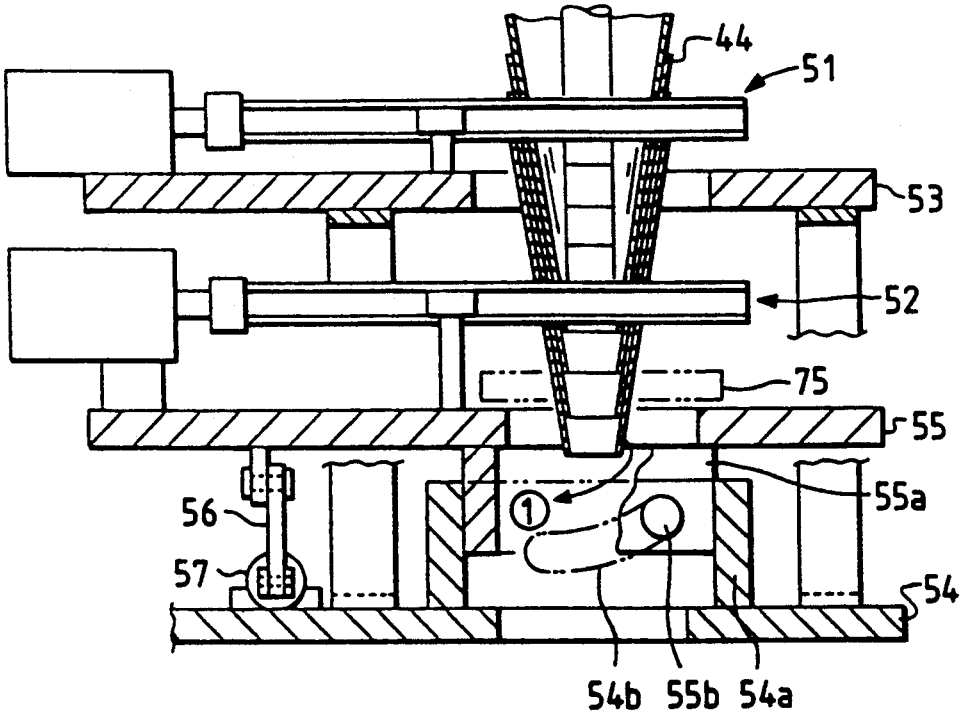
FIG. 4 is a sectional view taken at Y in FIG. 1.

In FIG. 1, the paper tube pull-out portion 16 is operatively connected with a first chuck 51 and a second chuck 52 to pull out and fall the lowermost paper tube of the group of paper tubes 44 projected from the paper tube storage portion 15. As shown in FIG. 4, a base 53 of the first chuck 51 is secured to a bed 54. A base 55 of the second chuck 52 has a small diameter tubular body 55*a*, which is fitted into a large diameter tubular body 54*a* of the bed 54. This large diameter tubular body 54*a* has a pair of cam grooves 54*b* on the side thereof (the other of which is symmetrical is present on the back), and a roller follower 55*b* mounted in the outer periphery of the small diameter tubular body 55*a* is engaged with the cam groove 54*b*. The base 55 can be moved down while being turned as indicated by the direction ① by a link 56 and a pneumatic cylinder 57 provided between the base 55 and the bed 54. This turning and falling motion pulls out the lowermost paper tube gripped by the second chuck 52. At this time, the first chuck 51 grips and fixes a group of paper tubes 44 other than the lowermost one.

Figure 5A:
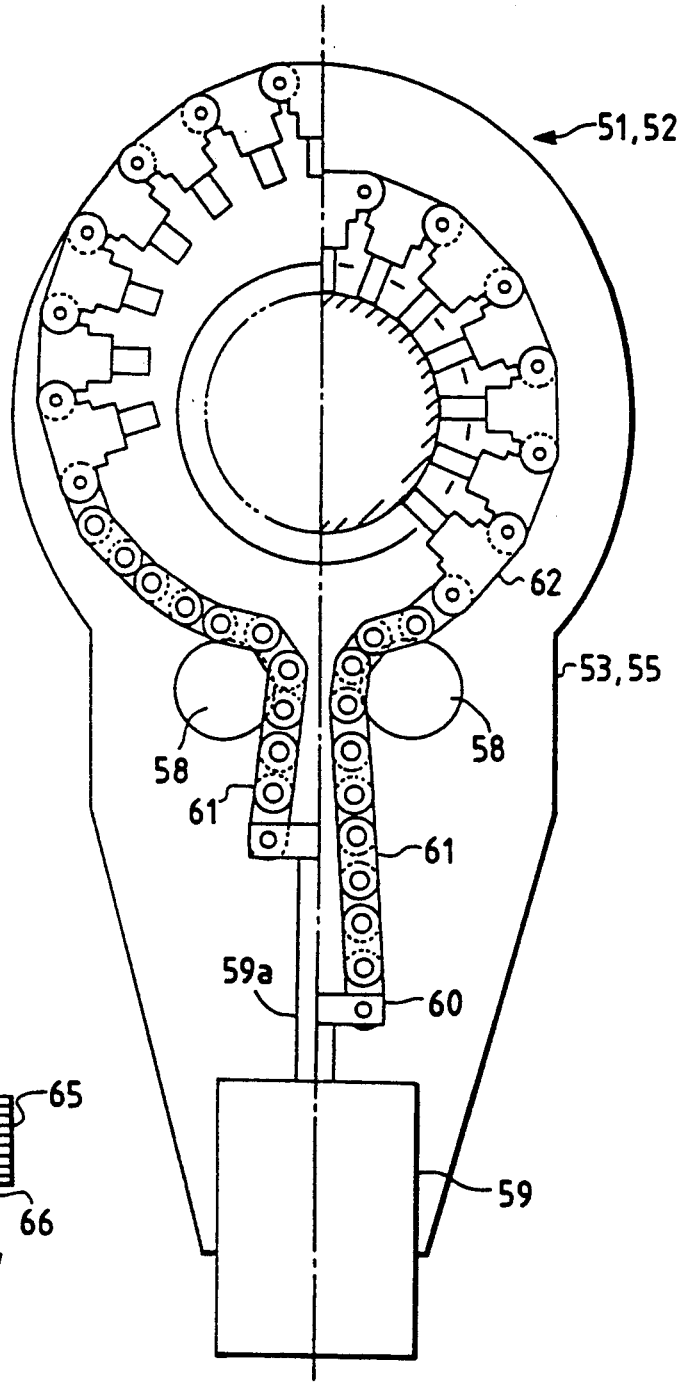
FIG. 5*a* is a top view of a chuck.
Figure 5B:
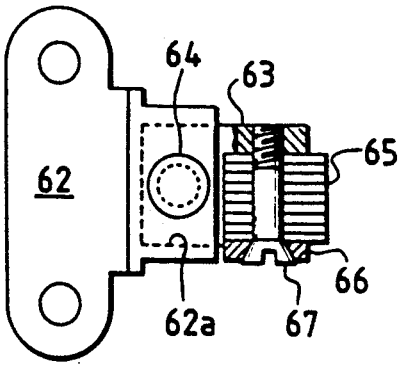
FIG. 5*b* is a detailed view of a portion of a special chain.

A construction of the first and second chucks 51 and 52 will be described with reference to FIG. 5. A pair of opposed guide rollers 58 and 58 are rotatably supported on the bases 53 and 55 and a pneumatic cylinder 59 is secured thereto. Both ends of a chain with a special chain 62 connected between standard chains 61 and 61 are connected to an end member 60 of a rod 59*a* of the pneumatic cylinder 59. Portions of the standard chains 61 and 61 are narrowed and guided by the guide rollers 58 and 58, and a portion of the special chain 62 is substantially in the form of a ring. There is a chain, so when it is supported at three points of the guide rollers 58, 58 and the end member 60, it maintains a substantially horizontal attitude without other guides. The special chain 62 is stopped by a pin 64 with an L-shaped piece 63 fitted into a recess portion 62*a*. A laminate of a urethane rubber sheet 65 is fastened to the side of the L-shaped piece 63 by a plate 66 and a bolt 67. In the first and second chucks 51 and 52 constructed as described above, when the rod 59*a* extends, the chucks 51 and 52 are in open state as shown at left in the figure, whereas when the rod 59*a* withdraws, the chucks 51 and 52 are in gripped state as shown at right in the figure. A paper tube is powerfully gripped by an end of the urethane rubber sheet 65 mounted on the special chain 62. It is necessary to exert a considerably powerful force to pull out stacked paper tubes, but when the chain and the urethane rubber are used, a gripping face pressure can be made uniform and increased to enable elimination of a pull-out failure.

In FIG. 1, the delivery portion 17 has an inlet chute 71, an endless belt 72, a pusher 73, and an outlet chute 74. A closing stopper 75 for a temporary stop is mounted adjacent one side of the inlet chute 71. The endless belt 72 is passed over between a drive pulley 76 and a driven pulley 77 and can be intermittently driven by a motor 78. A plurality of abutament plates 79 and a plurality of guides 80 are mounted in predetermined spaced relationship on the endless belt 72 so as to receive and hold paper tubes 13. Each guide 80 is normally urged to a predetermined position and is opened by an external force. Accordingly, advancement of a push plate 73*a* of the pusher 73 extrudes a paper tube 13 sidewards. As shown in FIG. 2, the paper tube 13 extruded to the outlet chute 74 assumes a horizontal attitude via an inclined surface 74*a* and is placed on the paper tube conveyor 26. Reference numeral 81 designates a sensor for detecting the presence and absence of the paper tube 13.

The operation of the aforementioned paper tube supply device 25 and the paper tube conveyer 26 will be described hereinafter. Upon reception of a paper supply command of a specific kind from a controller of an automatic winder, the pusher 73 of the paper tube supply device 25 which stores paper tubes of specific kind is operated so that the push plate 73a advances to extrude the paper tube 13 to the outlet chute 74. The paper tube 13 of specific kind rides on the paper tube conveyor 26 and is carried to the automatic winder. At the same time, the first and second chucks 51 and 52 in the pull-out portion 16 are operated to pull out one paper tube from the group of paper tubes 44. The pulled out paper tube 13 once stops at the stopper 75. When the stopper 75 gradually opens, the paper tube 13 enters into the guide 80 of the endless belt 72, and the paper tube 13 impinges on the abutment plate 79 and stops in a vertical attitude. When the sensor 81 detects the paper tube 13, the endless belt 72 is driven through one pitch P so that a new paper tube 13 is positioned in front of the pusher 73. Since three kinds of paper tube supply devices 25A, 25B and 25C are connected to the paper tube conveyor 26, as shown in FIG. 2, a paper tube of a specific kind requested by the automatic winder is delivered to the paper tube conveyor 26. Even if a request command is at random as in A→B→B→C, paper tubes timely placed in order of the request command can be delivered.

Figure 6:
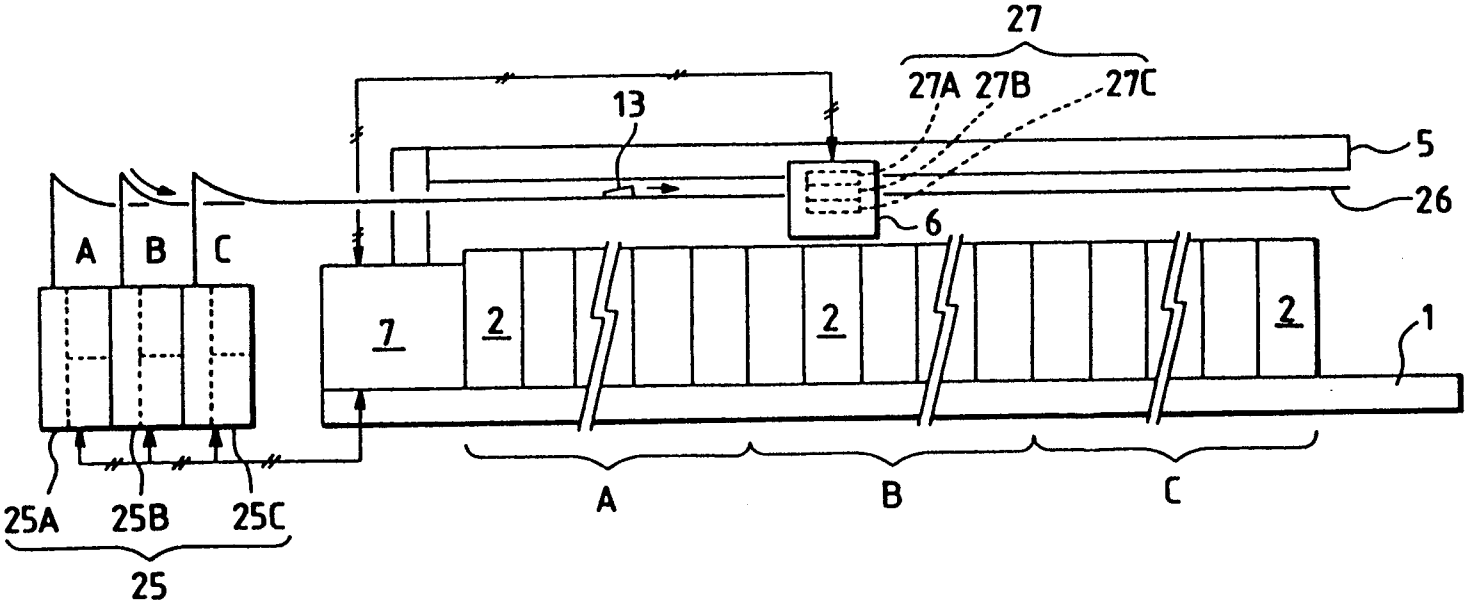
FIG. 6 is a side view showing the entire paper tube supply system.

Next, the whole paper tube supply system will be described with reference to FIG. 6. In FIG. 6, reference numeral 1 designates a frame; 2 a winding unit; 5 a rail; 6 a doffing device; and 7 a controller of an automatic winder. The controller 7 may communicate with a control box (not shown) associated with each winding unit 2, and the controller 7 is capable of determining which spindle stops with a full bobbin. Three paper tube supply devices 25A, 25B and 25C are installed on one end (left end not shown) of the automatic winder. The paper tube conveyor 26 connected to the paper tube supply devices 25A, 25B and 25C is provided in parallel with a running path of the doffing device 6. On the doffing device 6 is provided paper tube holding means 27 having three holding portions 27A, 27B and 27C. Three kinds (A, B and C) of paper tubes 13 are selectively delivered from the paper tube supply devices 25A, 25B and 25C to the paper tube conveyor 26, and the holding portions 27A, 27B and 27C of the paper tube holding means 27 sort and hold three kinds (A, B and C) of paper tubes.

The doffing operation by the aforementioned paper tube supply system will be described hereinbelow. It is assumed that a winding unit 2 of kind B stops with a full bobbin. The doffing device 6 runs to a position in front of this spindle. After the full package has been discharged, the paper tube of kind B held on the holding portion 27B is set to the cradle arm. At the same time, the paper tube of kind B is supplied from the paper tube supply device 25B to the paper tube conveyor 26 and carried to the doffing device 6. The paper tube supply device 25 is communicated with the controller 7 to receive a command to represent which kind of paper tube is required by the doffing device 6. The doffing device 6 then receives the paper tube of kind B, which is sent to an empty holding portion 27B. The doffing device runs to another spindle which requires doffing to repeat the same operation. That is, the doffing device 6 always has three kinds of paper tubes so that whenever either kind of paper tube is used, it is replenished automatically.

Figure 7:
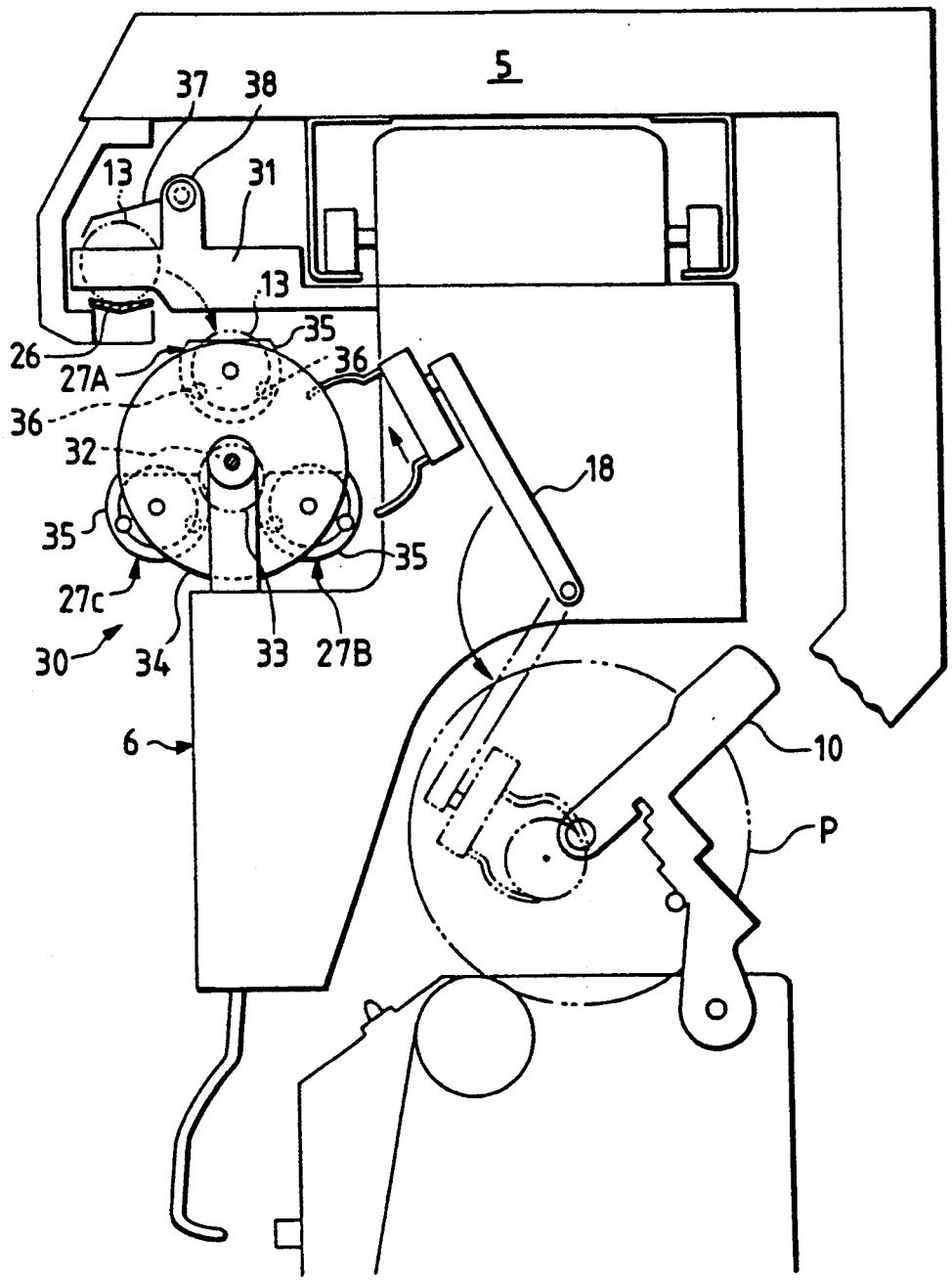
FIG. 7 is a side view of a doffing carrier.
Figure 8:
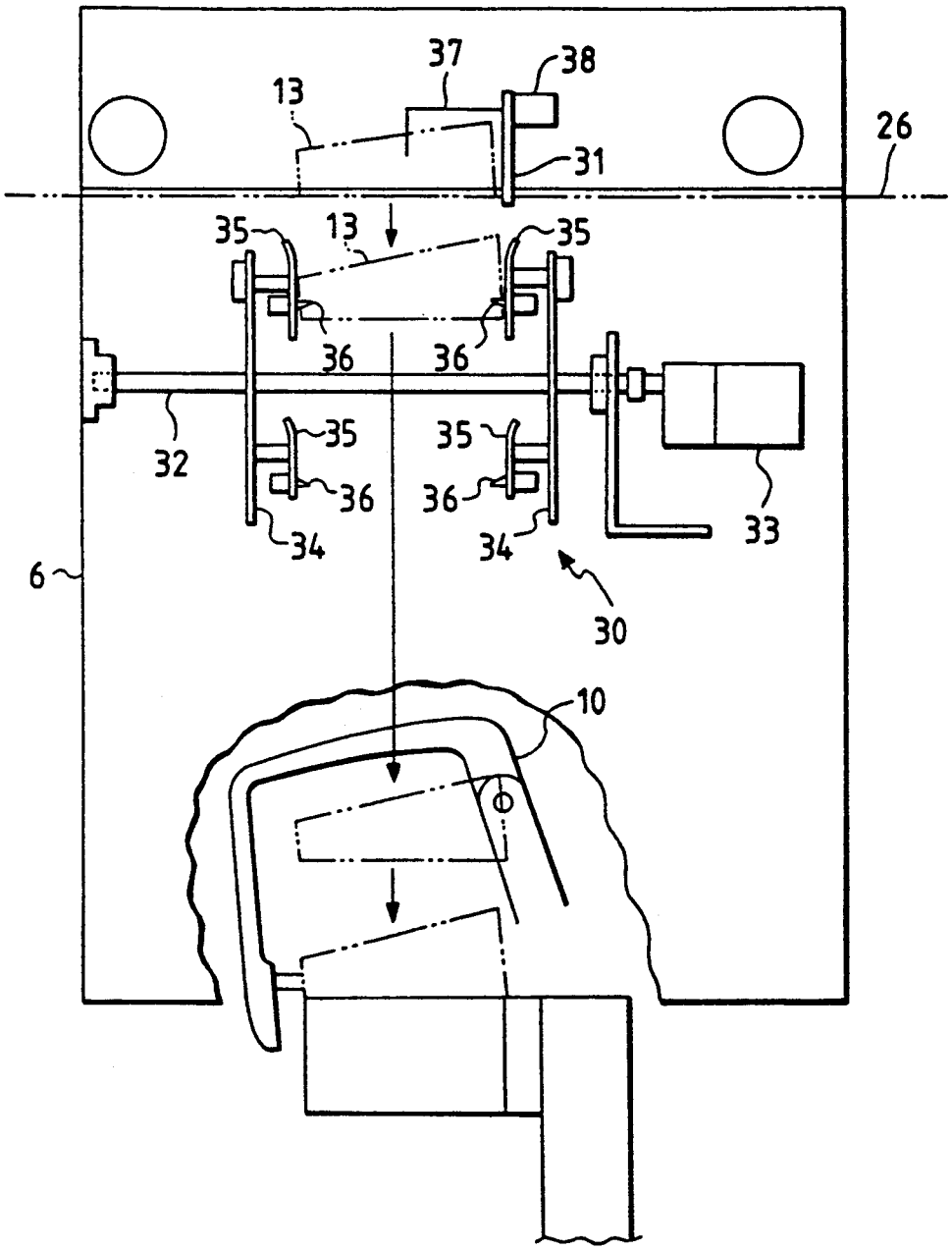
FIG. 8 is a front view of a doffing carrier.
Figure 9:
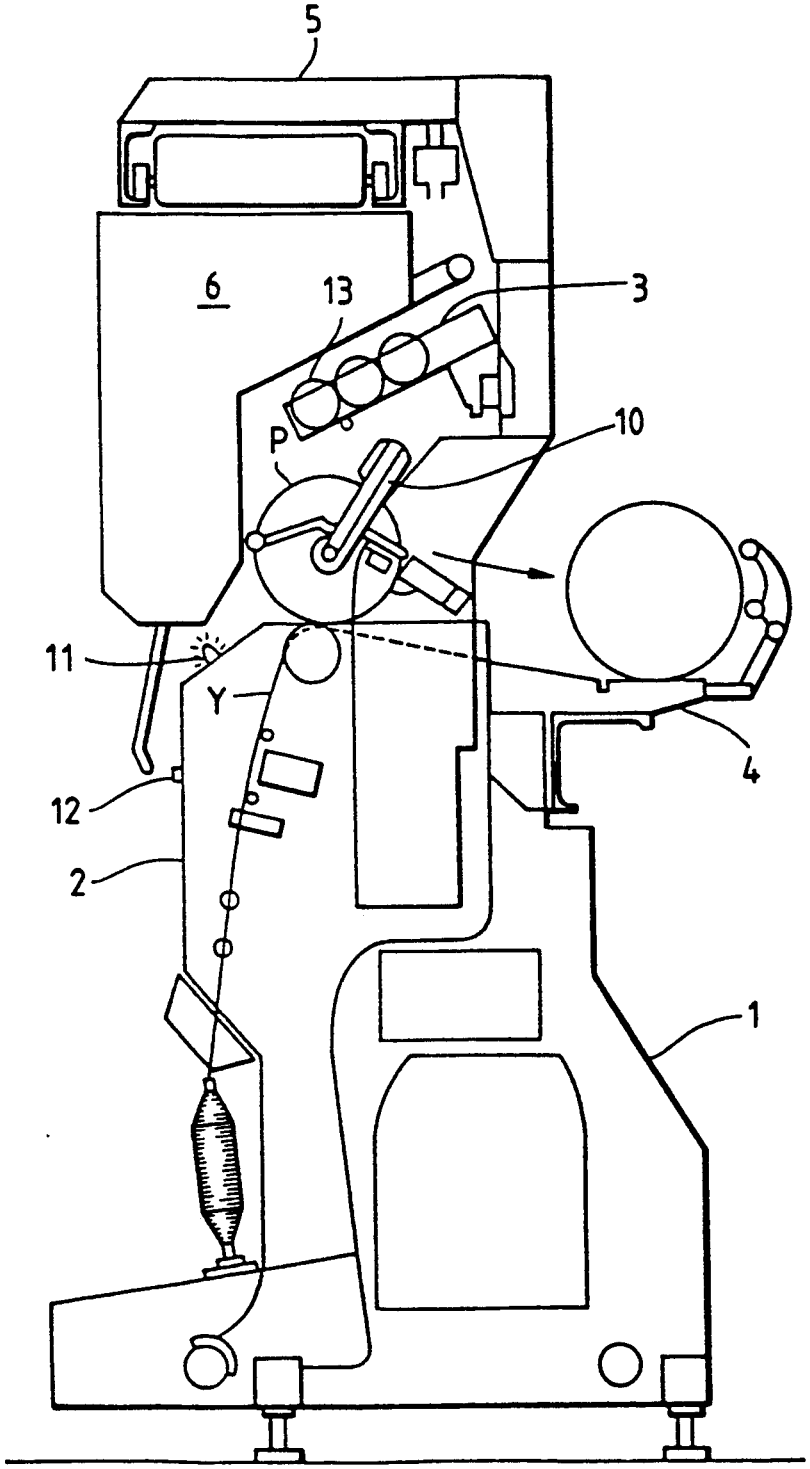
FIG. 9 is a side view showing a conventional paper tube supply system.

The paper tube holding means in the doffing device will now be described in detail with reference to FIG. 7 and FIG. 8. The paper tube holding means comprises a rotary reel 30, a guide plate 31 and a take-in arm 37. The construction of the holding portions 27A, 27B and 27C by the rotary reel 30 will be described. A shaft 32 is rotatably supported on a portion close to the paper tube conveyor 26 of the doffing device 6. A motor 33 or a rotary actuator (in case of two kinds) is connected to one end of the shaft 32 and can be rotated through the predetermined angle (120° for three kinds, and 180° for two kinds). A pair of disks 34 are fixedly mounted on the shaft 32, and rocking plates 35 are rockably supported at three equally spaced positions around the circumference of each disk 34. Freely moveable pawls 36 that are normally biased to project from the surface of the rocking plates 35 are mounted at two points at the lower parts of each rocking plate 35. The pawls 36 hold the paper tubes 13. However, when a chucker 18 grips and moves a paper tube 13 downward, the pawls 36 are moved out to release the holding of the paper tube. A suitable position deviation prevention means may be provided to prevent the position of the disks 34 from deviating during the operation of the chucker 18. A guide plate 31 is projected from the doffing device 6 so as to assume a position on the paper tube conveyor 26. The paper tube 13 carried by the paper tube conveyor 26 comes into contact with the guide plate 31 and stands-by while sliding on the paper tube conveyor 26. A solenoid 38 is fixedly mounted on the guide plate 31, and a take-in arm 37 is connected to a turning shaft of the solenoid 38. When the take-in arm 37 turns counterclockwise, the paper tube 13 which stands-by on the paper tube conveyor 26 falls in a direction as indicated by an arrow by the guide plate 31.

The operation of the aforementioned paper tube holding means is as follows. It is predetermined that paper tubes of kinds A, B and C are held by the holding portions 27A, 27B and 27C. The doffing device 6 performs doffing of the kind B. The disk 34 rotates, and the holding portion 27B assumes the illustrated position opposed to the chucker 18. The chucker 18 grips the paper tube 13 of the kind B and turns to the illustrated dash-dotted contour lines. Then, the disk 34 rotates and the illustrated holding portion 27B assumes a position of the holding portion 27A. The paper tube 13 of the kind B is carried by the paper tube conveyor 26 and standsby at the guide plate 31 during the aforementioned operation of the doffing device 6. After rotation of the disk 34, the solenoid 38 is operated so that the take-in arm 37 turns counterclockwise, and the paper tube 13 of the kind B is replenished into the rotated holding portion 27B. By the above-described repetition, the doffing device 6 automatically performs doffing to any of the kinds A, B and C.

In the paper tube supply system to the automatic winder according to the present invention, paper tubes of a specific kind requested by the automatic winder is pulled out from two or more paper tube supply devices which store a number of paper tubes every kind and delivered, and the pulled out paper tubes are supplied to the paper tube conveyor and carried to winding units for which doffing is requested via the paper tube conveyor. Therefore, labor is not necessary to replenish a variety of kinds of paper tubes, and automation is achieved.

Next, a method for controlling a travel of a doffing device will be illustrated.

A present position discrimination means is provided on a doffing device to communicate with a central control device into which a unit requiring doffing is inputted, whereby a direction to a unit requiring doffing is directed at the doffing device from the central control device so that the doffing device travels in a direction close to the unit.

Figure 10:
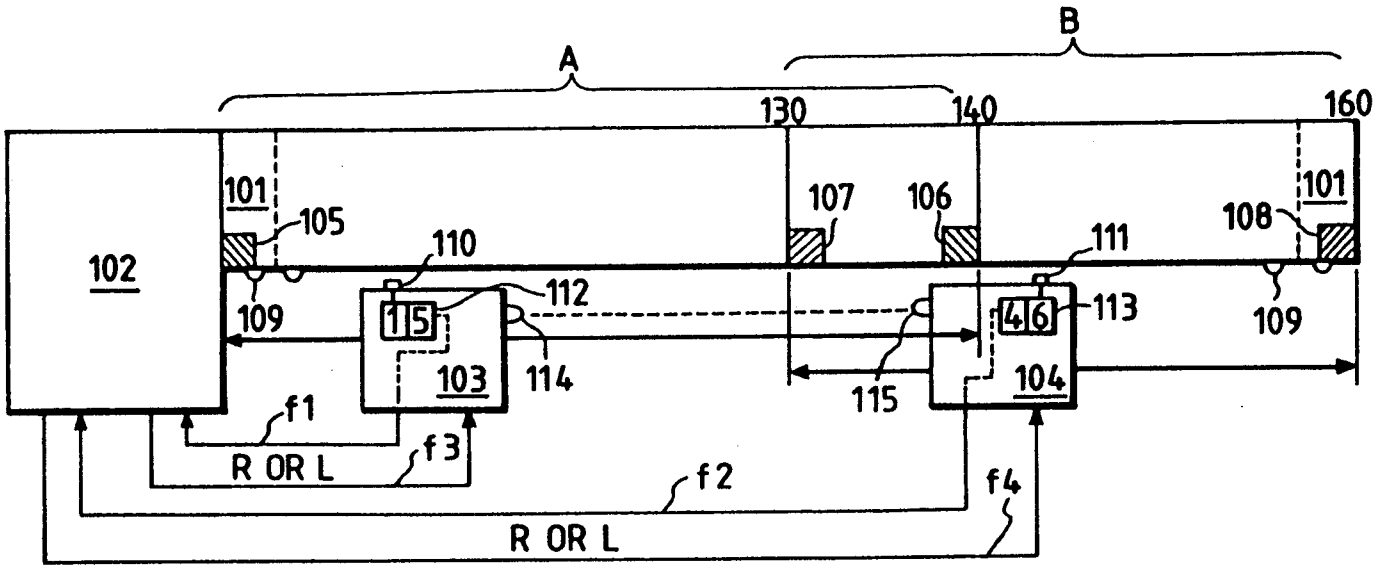
FIG. 10 is an appliance arrangement view of a unit, a central control device and a doffing device.

An embodiment of the method for controlling a travel of doffing device will be described hereinbelow while referring to the drawings. FIG. 10 is an appliance arrangement view of a unit, a central control device and a doffing device.

In FIG. 10, reference numeral 101 designates a number of winding units arranged in parallel; 102 a central control device; and 103 and 104 doffing devices. The winding units 1 are 60 in total, which are divided into a group A of 1 to 40 units, and a group B of 30 to 60 units. The group A is in charge of the doffing device 103, and the group B is in charge of the doffing device 104. Return magnets 105 and 106 are arranged on units on both ends of the group A and return magnets 107 and 108 are also arranged on units on both ends of the group B. When the return magnets 105 and 106 are detected by the doffing device 103, the doffing device 103 turns back the group A, and when the return magnets 107 and 108 are detected by the doffing device 104, the doffing device 104 turns back the group B. Reference numerals 114 and 115 designate light projector-receivers. The light projector-receiver 114 of the doffing device 103 has a high emission intensity. The doffing devices 103 and 104 have douplicate areas in charge (30 to 40 units). The doffing device 104 is early inverted to avoid mutual interference.

A block 109 is mounted on the winding unit 101. When this block 109 is detected by detectors 110 and 111 of the doffing devices 103 and 104, numerical values of counters 112 and 113 encased in the doffing devices 103 and 104 increase and decrease. The counters 112 and 113 increase when the doffing devices 103 and 104 move rightward, and the counters 112 and 113 decrease when the doffing devices 103 and 104 move leftward. The present position of the doffing devices 103 and 104 can be recognized by unit numbers. At the outset of operation, when the return magnets 105 and 107 are detected by the doffing devices 103 and 104, 1 or 30 is reset. Present position information of the counters 112 and 113 is inputted into the central control device 102 through control lines f1 and f2. The central control device 102 is communicated with a local control device of each winding unit 101 through control lines not shown, and numbers of units requiring doffing are inputted.

The central control device 102 is operated in accordance with the procedure of a flow chart which will be described later. As a result, directions (right R or left L) of units requiring doffing are directed at the doffing devices 103 and 104 through control lines f3 and f4. If that direction coincides with the travel direction of the doffing devices 103 and 104, the doffing devices travel as they are. If that direction is in the opposite direction, the doffing devices 103 and 104 are inverted and travel. In the case where the doffing devices 103 and 104 do not always travel and no direction is provided from the central control device for a given period of time, the doffing devices travel or standby in front of the winding units being stopped or in the central portion of the groups A and B. If direction R or L is provided from the central control device 102, the doffing devices travel in that direction to detect a green lamp and stops, after which they carry out doffing.

Figure 11:
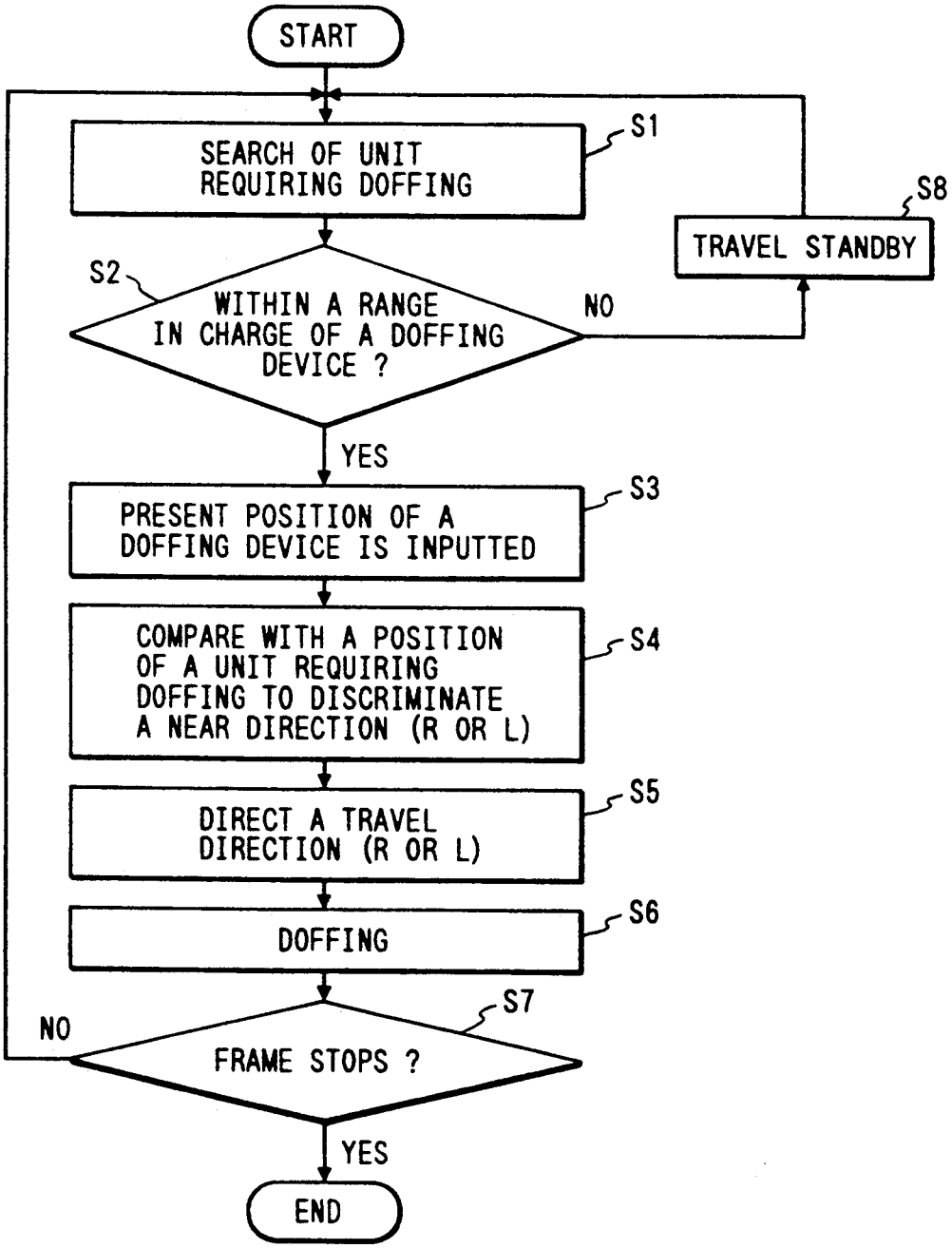
FIG. 11 is a flow chart relating to a direction of a travel direction of a central control device.

Next, the procedure relating to direction of a travel direction by the central control device will be described with reference to FIG. 11, a flow chart. In Step S1, the flow starts with a search of a unit requiring doffing. In Step S2, if a unit requiring doffing is present (YES) within a range in charge of a doffing device, a present position of the doffing device is inputted in Step S3. In Step S4, the present position is compared with a position of a unit requiring doffing to discriminate a near travel direction (R or L). In Step S5, a travel direction (R or L) is directed at the doffing device. In Step S5, doffing is carried out. If, in Step S2, a unit requiring doffing is outside a range in charge of a doffing device, the doffing device moves toward and stops at a travel standby position in Step S8. If a unit requiring doffing is detected in the midst toward the travel standby position, the process returns to Step S1. In case of no frame stop in Step S7, the processes of Steps S1 to S7 are repeated, and the flow terminates with a frame stop. In this manner, when a travel standby of Step S8 is provided, wasteful travel of the doffing device is saved. Wear of a cable bearer and a travel roller is reduced, and energy is saved.

In a method for controlling travel of a doffing device according to the present invention, a present position discrimination means is provided on a doffing device, and communication is made with a central control device whereby a direction to a unit requiring doffing is directed at the doffing device by the central control device so that the doffing device travels in a near direction. Therefore, a roundabout way can be reduced to enhance a working efficiency of the doffing device. Furthermore, extra travel can be saved to extend a service life of wearing portions of a doffing device.

In a doffing device for carrying out a series of operations including releasing of a full package and mounting of an empty paper tube through a cam, bunch winding driving to an empty paper tube is preferably carried out by a motor independently of the cam.

When the bunch winding driving is carried out by an independent motor separately from a cam, an amount of bunch winding waries with time or speed control of the motor.

Figure 17:
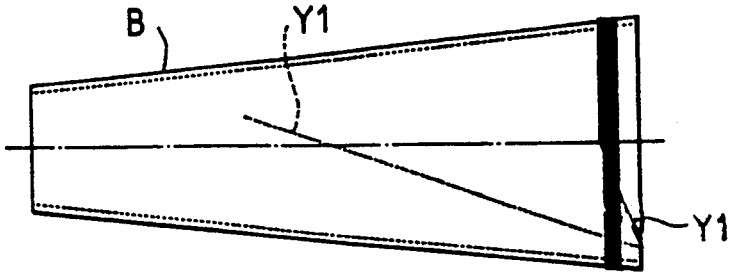
FIG. 17 is a front view showing a bobbin being subjected to bunch winding.
Figure 18:
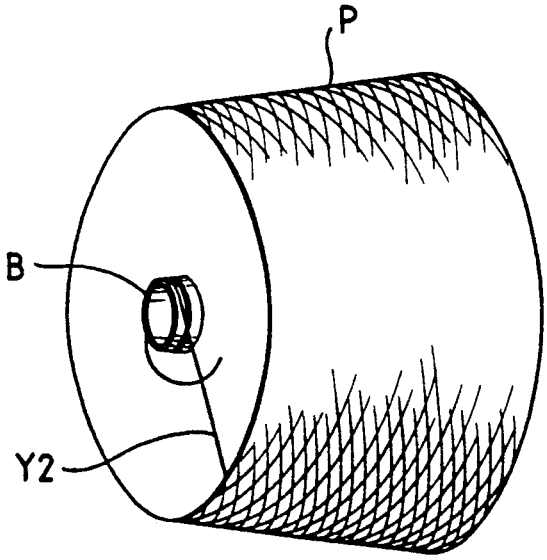
FIG. 18 is a perspective view showing a nose-wound package.

An embodiment of the doffing device of present invention will be described hereinbelow with reference to the drawings. Bunch winding formed by the doffing device of the present invention will be described with reference to FIGS. 17 and 18. FIG. 17 shows bunch winding to an empty paper tube B. A yarn end Y1 is prevented from entry into the empty paper tube B. The bunch winding is applied in a direction as indicated by arrow so as to be positioned on the yarn end Y1, and the yarn end is prevented from being simply disengaged. FIG. 18 shows a nose bunch to a full package P. The doffing device of the present invention can form the nose bunch of FIG. 18 simultaneously with the bunch winding of FIG. 17. In the nose bunch, the last yarn end Y2 is wound on a small-diameter side of the empty paper tube B, and the yarn end is easily taken out as compared with one which is wound on the outer periphery of a normal package.

Figure 12:
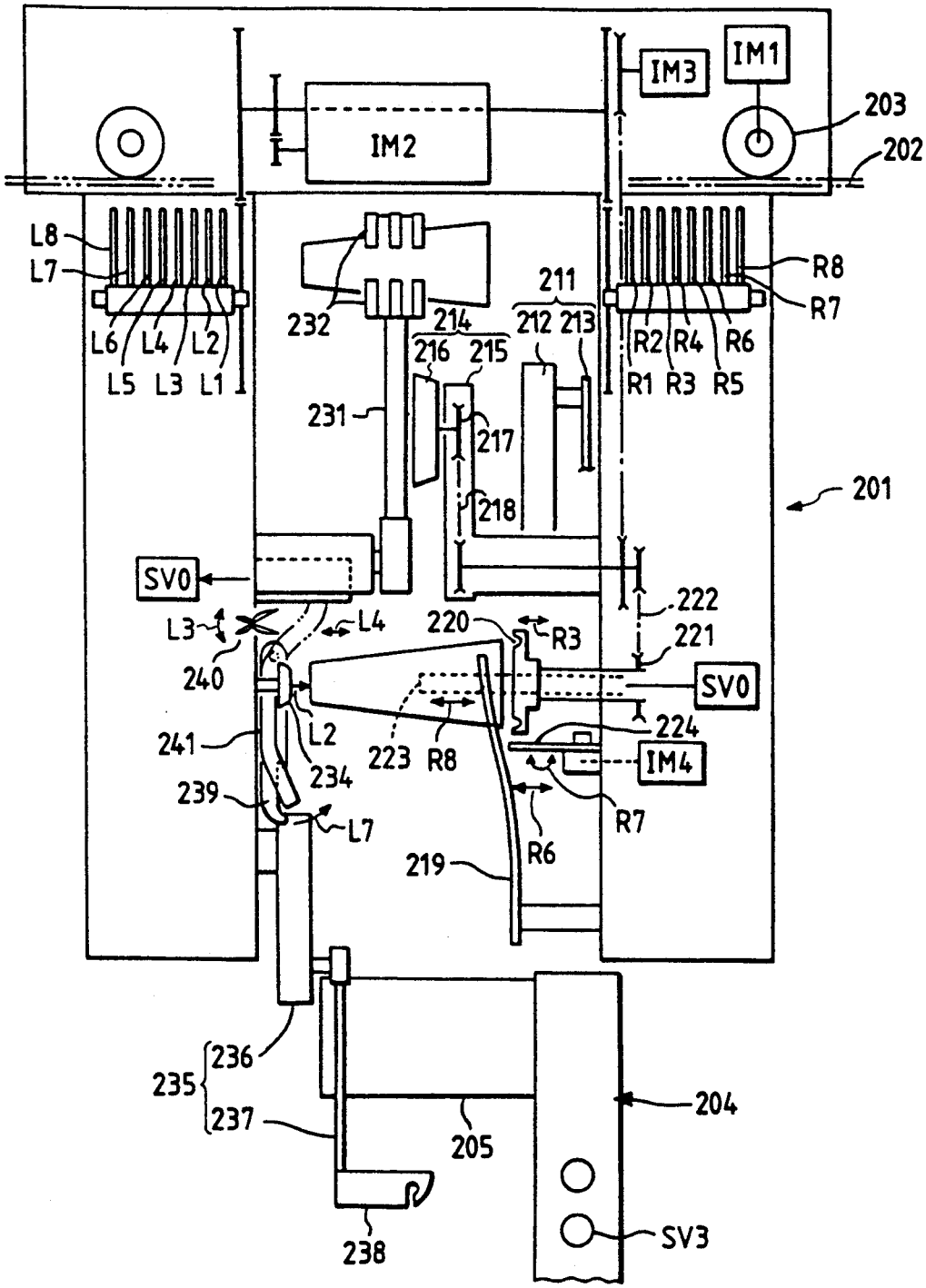
FIG. 12 is a front view of a doffing device.

Next, an appliance structure of the doffing device capable of simultaneously forming the aforementioned bunch winding and nose bunch will be described with reference to FIGS. 12 to 15. FIG. 12 is a front view of the doffing device, FIG. 13 is a right side view of the doffing device, FIG. 14 is a left side view of the doffing device, and FIG. 15 is a structural view of a bunch guide.

Figure 13:
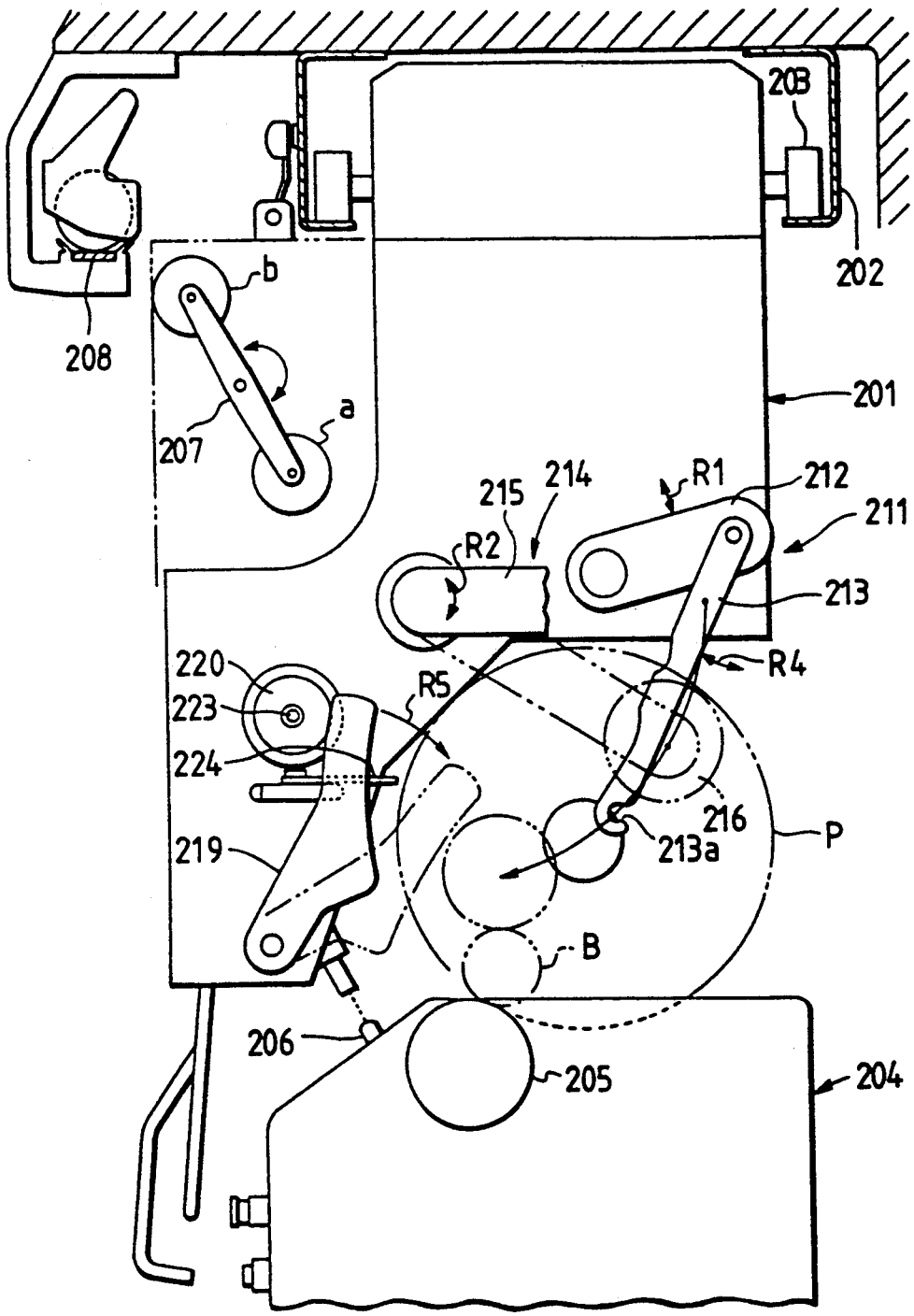
FIG. 13 is a right side view of a doffing device.
Figure 14:
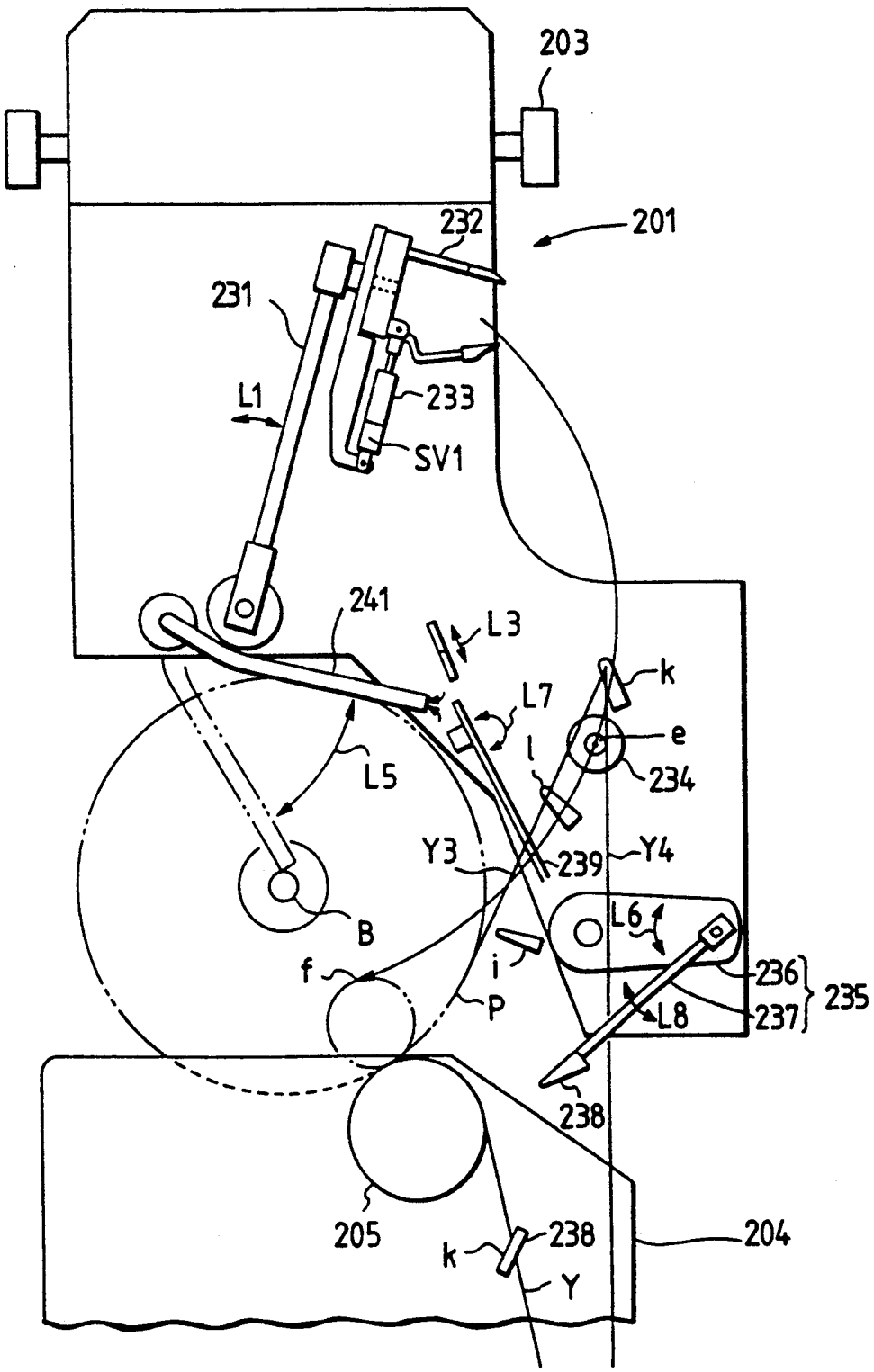
FIG. 14 is a left side view of a doffing device.
Figure 15:
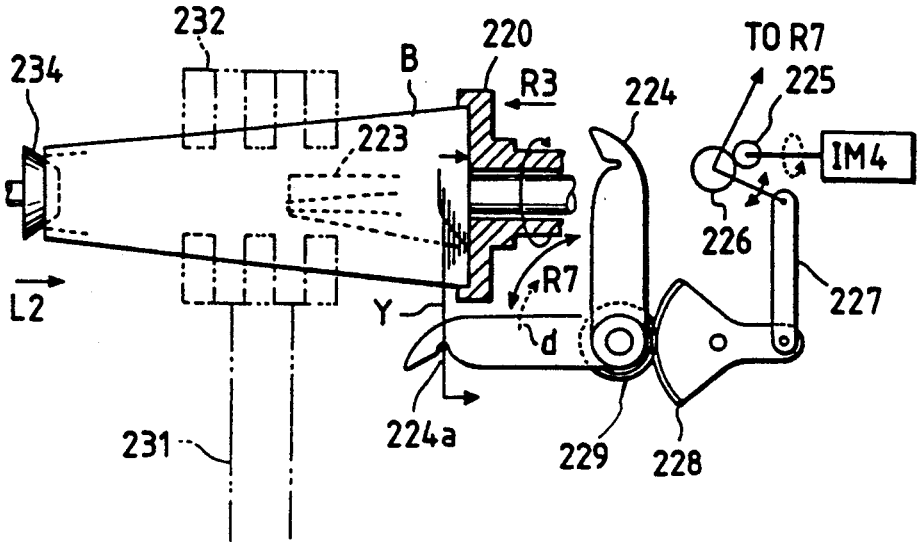
FIG. 15 is a side view showing the procedure of bunch winding.

In FIGS. 12 to 14, a doffing device 201 can freely travel on a rail 202 by a wheel 203. The wheel 203 is controlled variably in rotation (r.p.m.) by a motor IMI controlled by an inverter, and can be accelerated and decelerated smoothly from high speed to low speed. A winding unit 204 shows an upper portion including a traverse drum 205. The doffing device 201 can freely travel immediately above the winding unit 204, and detects lighting of a green lamp 206 and stops at a predetermined position to effect doffing. In FIG. 13, the doffing device 201 has a turnable paper tube holding device 207 to sort and hold each one of two kinds of paper tubes. A paper tube at position a is mounted on the winding unit and turns to a position b. A new paper tube of a predetermined kind is supplied from a conveyor 208 to the position b. In this manner, a paper tube of a specific kind can be mounted on the winding unit 204, and the doffing device 201 itself need not to have a number of paper tube boxes.

Various appliances provided on the right side of the doffing device 201 will be described with reference to FIGS. 12 and 13. Reference numeral 211 denotes a hooker comprising a hooker arm 212 and a hooker lever 213. A cradle arm not shown is caught and raised up to a predetermined position by a catcher portion 213*a* at the extreme end of the hooker lever 213. A position of a full package P subjected to nose bunching is determined by the hooker 211. The hooker arm is turned by a cam R1 and the hooker lever 213 is turned by a cam R2. These operations are cooperated to catch the cradle arm to raise it up to a predetermined position.

Reference numeral 214 designates a roller comprising a roller arm 215 and a rubber roller 216. The roller 214 causes a full package P to rotate at the time of the nose bunch and an empty paper tube B mounted on the cradle arm to rotate to remove a looseness of a yarn. The roller arm 215 is turned by a cam R2, and the rubber roller 216 is driven by a motor IM3 controlled by an inverter through a sprocket 217 and a chain 218. That is, the rotation and the rotating time of the rubber roller 216 can be freely set separately from the cam.

Reference numeral 219 designates an opener which opens and closes a cradle arm in order to release a full package P and mount an empty paper tube B after formation of bunch winding and nose bunch. The opener 219 is turned by a cam R5, and is laterally slid by a cam R6.

Reference numeral 220 designates a chuck for mounting an empty paper tube B to a bunch winding position, and the chuck is moved forward and backward by a cam R3. However, the rotation of the chuck 220 itself is driven by a motor IM3 controlled by an inverter through a sprocket with an anti-reversal clutch 221 and a chain 222. That is, the rotation and rotating time of the chuck 220 can be freely set separately from the cam, and an amount of bunch winding is variable.

Reference numeral 223 designates a suction nozzle for sucking a yarn end, and the nozzle is moved forward and backward by a cam R8. This nozzle functions as an air sucker by opening and closing of a solenoid SV0. That is, a yarn sandwiched between the empty paper tube B and the chuck 220 has been cut by a cutter which will be described later, after which a minute clearance is formed between the empty paper tube B and the chuck 220 to suck a yarn end.

Reference numeral 224 designates a bunch guide for forming a bunch winding on an empty paper tube B, and the bunch guide is rocked by a cam R7. As shown in FIG. 15, the bunch guide 224 has a groove 224*a*, and a yarn Y is set to a predetermined position of bunch winding. However, the bunch winding is deviated in a direction of arrow c by a motor IM4 controlled by an inverter. A lever 227 is slightly pressed through gears 225 and 226 to slightly rock the bunch guide 224 in a direction indicated by dotted arrow d via gears 228 and 229 to deviate the bunch winding in a direction of arrow c. This motor IM4 is operatively connected with a motor IM3 for rotating an empty paper tube B to enable formation of a predetermined amount of bunch winding at a desired pitch.

Various appliances provided on the left side of the doffing device 201 will be described with reference to FIGS. 12 and 14. Reference numeral 231 designates a chucker which grips an empty paper tube B to carry it to a bunch winding forming position e and a mounting position f to a cradle arm. The chucker 231 is turned by a cam L1 and a pawl 232 is opened and closed by a cylinder 233 actuated by a solenoid SV1.

Reference numeral 234 designates a chuck for mounting an empty paper tube B, and the chuck 234 is moved forward and backward by a cam L2. An extreme end of the chuck 234 is tapered, and the chuck 234 is cooperated with the chuck 220 provided on the right side to force-widen a small diameter side of the empty paper tube B to grip it.

Reference numeral 335 designates a pickup comprising a yarn pickup arm 236 and a yarn pickup lever 237, and a yarn pickup guide 238 is mounted on the extreme end of the yarn pickup lever 237. The yarn pickup arm 236 is turned by a cam L6, and the yarn pickup lever 237 is turned by a cam L8. As shown in FIG. 14, a full package P by a roller not shown, that is, a yarn Y traversed by rotation of the traverse drum 205 is caught by the yarn pickup guide 238 at a position h. The yarn pickup guide 238 moves to h→i→j→k to make yarns into Y3 and Y4 in an acute angle state.

Reference numeral 239 designates a yarn handler lever, and this lever is turned by a cam L7. Reference numeral 240 designates a cutter, and this cutter is opened and closed by a cam L3. A yarn Y3 is moved close to the cutter 240 to cut the same, and after this, a yarn end Y3 is sucked toward a nose bunch guide 241. The yarn end Y4 is sandwiched between the empty paper tube B and the chuck 220 shown in FIG. 13.

Reference numeral 241 designates a nose bunch guide, and this guide is laterally slid by a cam L3 and is turned by a cam L5. The nose bunch guide 241 also functions as an air sucker by opening and closing of a solenoid SV0. When the rubber roller 216 (see FIG. 12) comes into contact therewith and the full package P is reversed, a yarn end Y3 released by the nose bunch guide 241 is sucked. A length of the sucked yarn end Y3 is a length of the nose bunch. Accordingly, a length of the nose bunch is suitably adjusted by a motor IM3 for driving the rubber roller 216. As shown in FIG. 14, the nose bunch guide 241 is positioned on the small diameter side of the empty paper tube B on the full package P, and forms a nose bunch while sliding with the rotation of the full package P.

The procedure for forming a bunch winding by the various appliances of the doffing device 201 will be briefly described with reference to FIG. 15. An empty paper tube B is gripped by the pawl 232 of the chucker 231 and carried to an axis position of the chucks 220 and 234. The chucks 220 and 234 advance in the direction of L2 and R3 to grip an empty bobbin. At that time, a yarn end sucked into the suction nozzle 223 at a withdrawal position is sandwiched between the chuck 220 and the empty paper tube B. The bunch guide 224 is turned in a direction of R7 to position the yarn Y at a groove 224*a*. When the chuck 220 is rotated, a bunch winding is formed. At the same time, the bunch guide 224 is gradually turned in a direction of d, and the bunch winding moves in a direction of c. An amount of bunch winding is determined by the number of revolutions of the chuck 220. Upon termination of bunch winding, the bunch guide returns to a position indicated by dash-dotted contour lines, and the empty paper tube B is again gripped by the pawl 232 of the chucker 231 and carried to the cradle arm. The yarn end within the suction nozzle 223 is discharged into the empty paper tube B before the empty paper tube B is carried to assume a state shown in FIG. 17 and it is mounted on the cradle arm.

Figure 16:
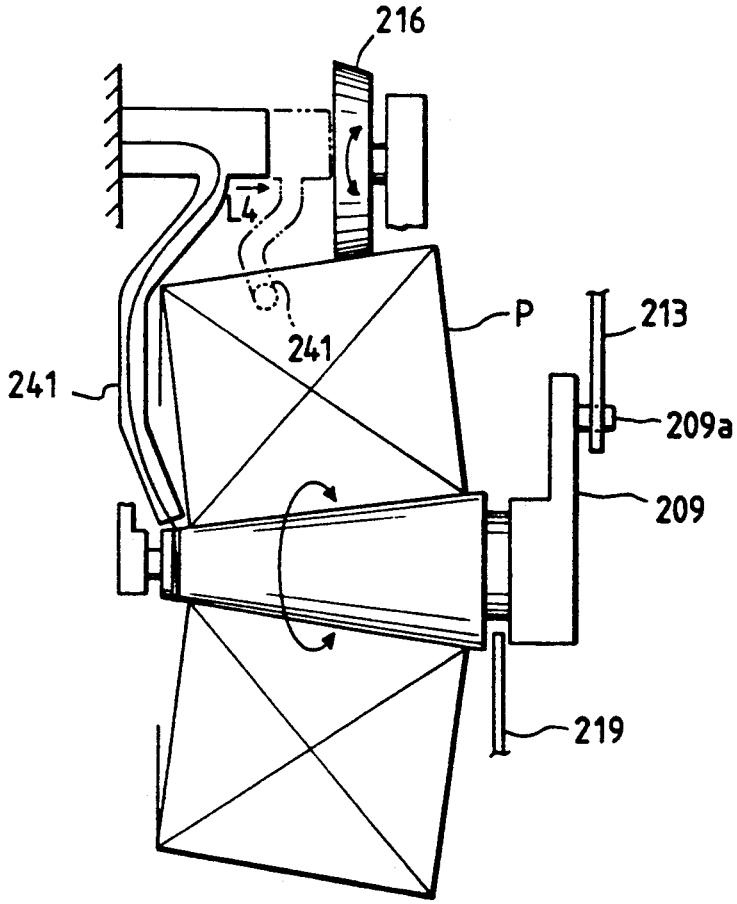
FIG. 16 is a side view showing the procedure of nose bunch.

Next, the procedure for forming a nose bunch will be described with reference to FIG. 16. A full package P is gripped by the cradle arm 209. A pin portion 209*a* of the cradle arm 209 is caught by the hooker lever 213, and the full package P assumes a predetermined position. When the nose bunch guide 241 is at a position indicated by dash-dotted contour line (near a location where a yarn is cut by a cutter), a yarn end is sucked. By rotation of the rubber roller 216, a full package is reversed, and a released yarn end is sucked. A length of the nose bunch is determined by a length of the released yarn end, that is, the number of revolutions of the rubber roller. Then, the nose bunch guide 241 is moved to a position indicated by solid line and opposed to the small diameter side of the paper tube. By rotation of the rubber roller 216, a full package is normally rotated, and a yarn sucked into the nose bunch guide 241 is wound on the small diameter side of the paper tube to form a nose bunch. At that time, the nose bunch guide 241 gradually moves in a direction of L4 to form a nose bunch as shown in FIG. 18. Upon termination of the nose bunch, the cradle arm 209 is opened by the opener 219 to release the full package P. The bunch wound empty paper tube is carried to a position of the cradle arm 209, and the cradle arm 209 is closed by the opener 219 so that an empty paper tube B is mounted.

As mentioned above the present invention provides a doffing device for carrying out a series of operations including releasing of a full package and mounting of an empty paper tube through a cam, wherein bunch winding driving to an empty paper tube is carried out by a motor independently of the cam. An amount of bunch winding is varied by time or speed control of the motor, and therefore, an amount of bunch winding can be suitably adjusted.

Furthermore, the present invention provides a doffing method for an automatic winder wherein at the time of doffing, a signal is sent from a doffing carriage to a winding unit, a drum motor of the winding unit is driven at a low speed in response to said signal to rotate a package on a traverse drum, and a bobbin yarn is picked up.

When a bobbin yarn is picked up, rotation of a package by a bunch roller in prior art is not carried out but a drum motor is driven at a low speed to rotate a package. Therefore, a package caused by the bunch roller in prior art is prevented from being damaged. Further, it is possible to positively rotate a package to pickup a bobbin yarn without being affected by the size of package, kinds of yarns, the way of winding, etc.

One embodiment of the doffing method of the present invention mentioned above will be described in detail with reference to the accompanying drawings.

Figure 19:
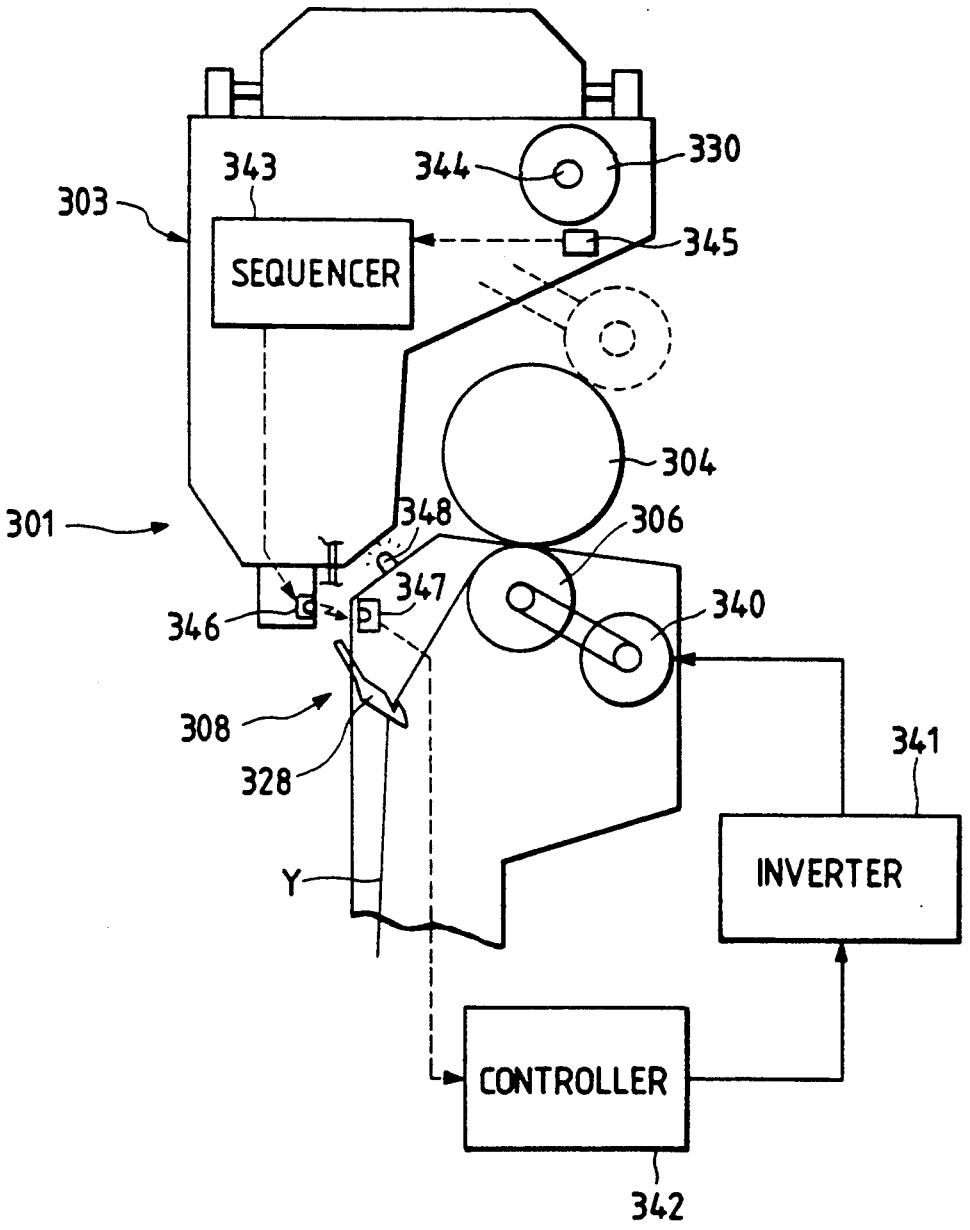
FIG. 19 is a schematic view showing a control system for working the system of the present invention.

An automatic winder 301 shown in FIG. 19 comprises a number of winding units 302 arranged in parallel and a doffing carriage (autodoffer AD) 303 which moves along each unit, the winding unit 302 having a cradle portion 305 and a traverse drum 306. A yarn handler device 308 of the autodoffer 303 has a yarn pickup guide 328 which moves between a knotter and a traverse drum to catch a bobbin yarn Y to guide the latter to a cutter position. The entire automatic winder 301 is constructed such that rotation of a package to pick up a bobbin yarn is effected by rotating a traverse drum 306 of a winding unit 302 at a low speed.

Figure 20:
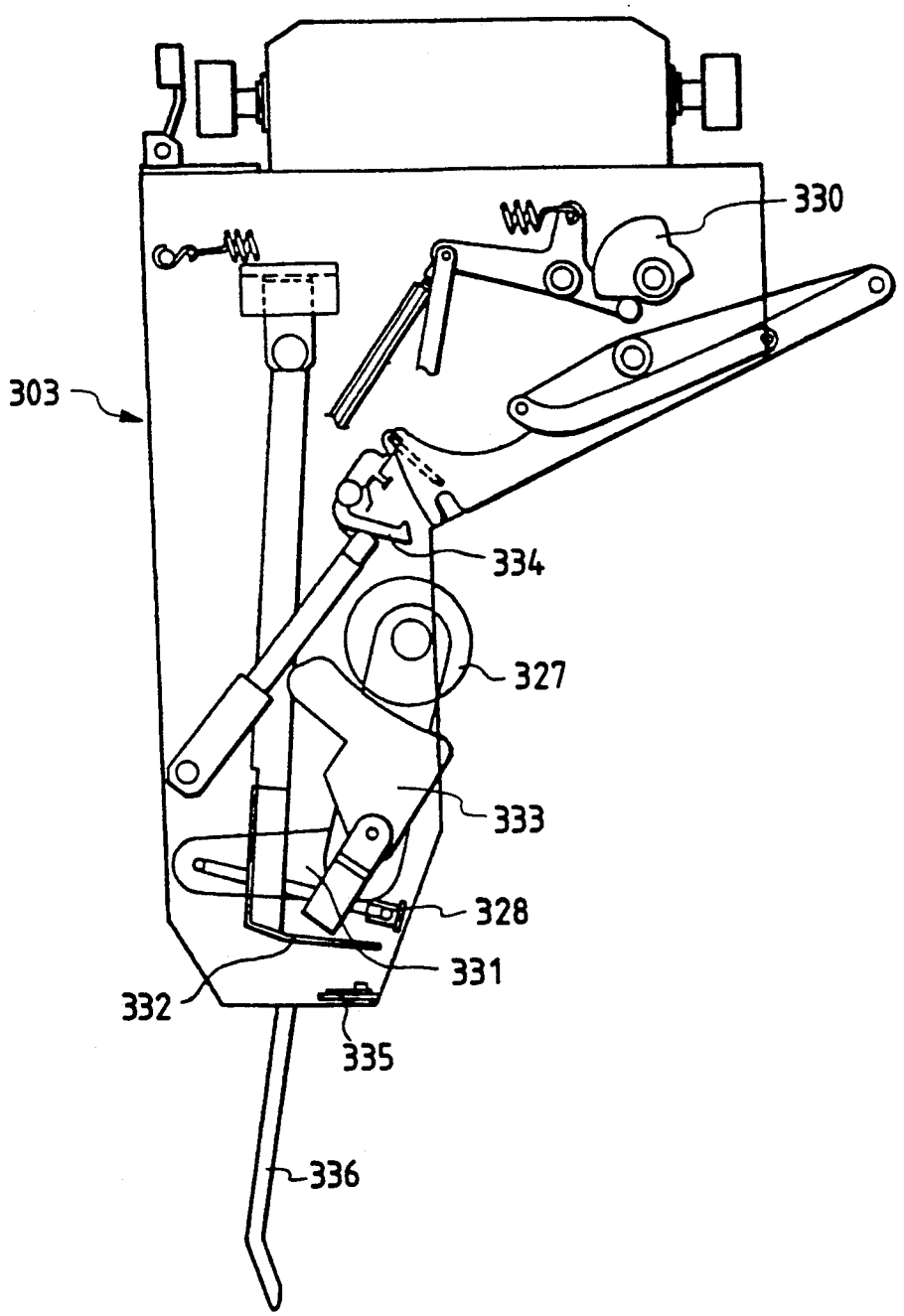
FIG. 20 is a view showing the structure of an autodoffer shown in FIG. 19.
Figure 21:
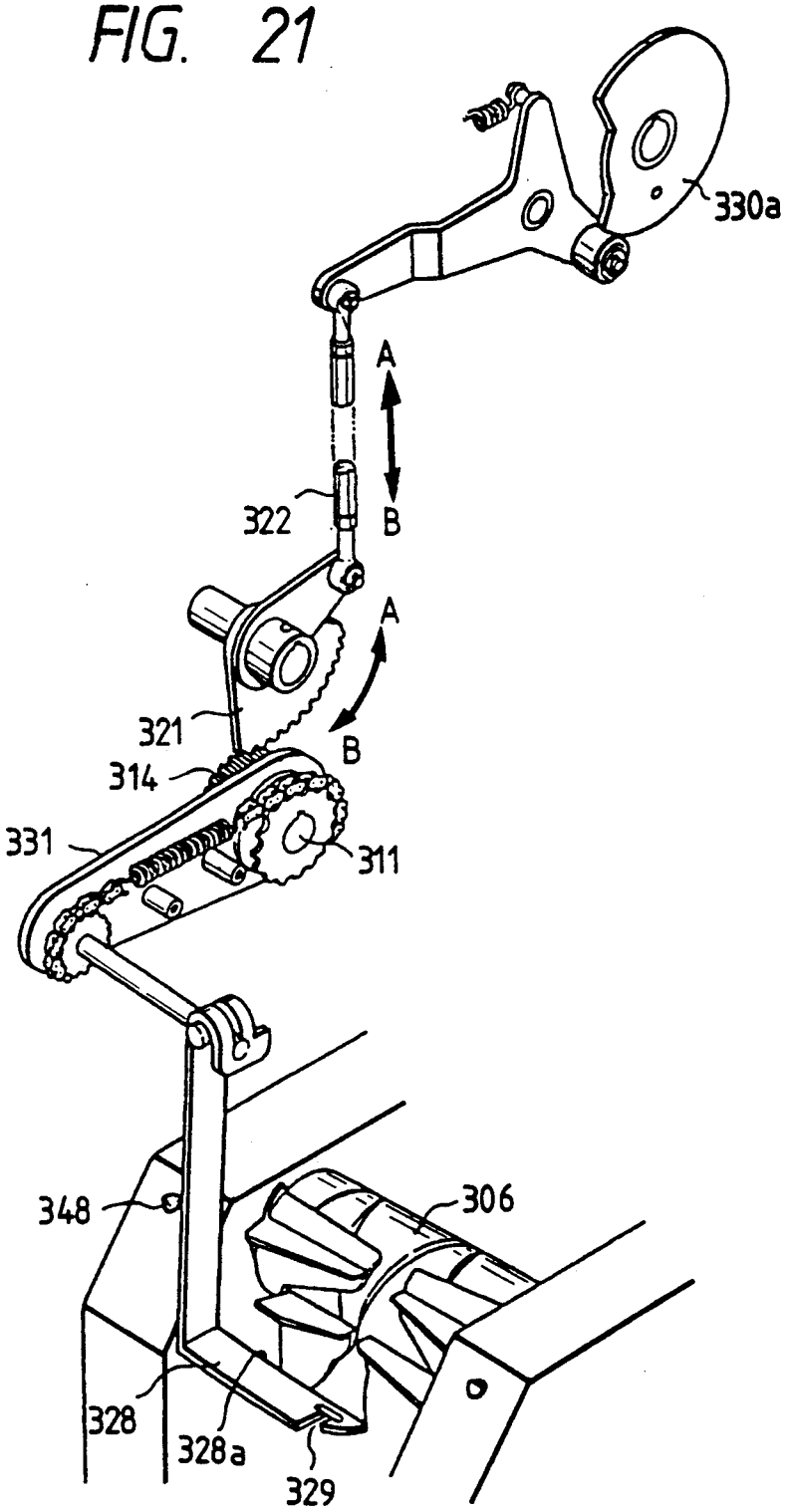
FIG. 21 is a perspective view showing a structural example of a yarn pickup guide shown in FIG. 20.
Figure 25:
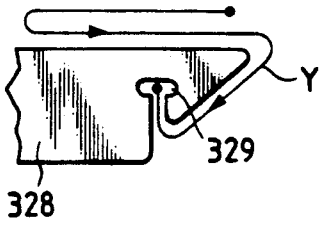
FIG. 25 is schematic view showing the process in which the yarn pickup guide shown in FIG. 21 picks up a yarn.

In this automatic winder, when a full package is doffed, a yarn pickup guide 328 of the autodoffer 303 is moved down from the FIG. 20 position to the FIG. 21 position, and a yarn Y to be traversed is caught by a pickup 329 as shown in FIG. 25 by rotation of the traverse drum 306, after which the thus caught bobbin yarn Y is raised up to a cutting position to cut it.

First, when a rod 322 is pulled down in a direction as indicated by arrow B in FIG. 21 by a cam 330*a* which is one of a program cam 330, a gear 341 meshed with a sector gear is rotated counterclockwise by the turning of said gear 321, a shaft 311 having the gear 314 fixed thereto also rotates in the same direction, and a yarn handler arm 331 fixed to the shaft 311 turns counterclockwise. That is, the yarn pickup guide 328 moves between the knotter and the traverse drum 306 to assume a position (position in FIG. 21) capable of catching the bobbin yarn Y so that an inner side edge 328*a* of the yarn pickup guide 328 is engaged with the bobbin yarn Y so as to hold the bobbin yarn Y from outside (see FIG. 19).

Next, the traverse drum 306 is rotated at a low speed to traverse the bobbin yarn Y as indicated by arrow in FIG. 25. By this traverse, the yarn Y is guided into a pickup 329 formed on the outer side edge of one end portion of the yarn handler guide 328. Thereafter, when the rod 322 is raised upward (in a direction indicated by arrow A in FIG. 21), the sector gear 321 turns whereby the yarn handler arm 331 turns clockwise and the yarn Y is raised to a cutting position while being caught by the pickup 329 of the yarn handler guide 328. Thereafter, a yarn end is cut by a cutter 332 (FIG. 20). However, the cutter 332 grips an extreme end of the bobbin yarn after being cut.

Thereafter, the package 304 is removed from a cradle arm by an opener 333. A new bobbin (paper tube) is mounted on the cradle arm by a chucker 334, and an extreme end of the bobbin yarn Y having been gripped by the cutter 332 is wound and subjected to bunch winding while the new bobbin is rotated by a bunch roller 327. At the time of the bunch winding, the yarn Y is moved by a yarn handler lever 335 from a position gripped by a cutter to a large diameter side of a bobbin and forced between the bobbin and the cradle arm. Finally, when the program cam 330 returned to its original point, the traverse drum 306 starts at a high speed to restart preparation of a package. Accordingly, the autodoffer 303 is not provided with a start lever 336 for depressing a start button on the side of the winding unit 302. However, at the time of inching operation of the autodoffer 303 and at the time of manual doffing, an operator depresses a drum start button to enable starting.

Turning again to FIG. 19, the winding unit 302 is provided with a drum motor 340 for driving the traverse drum 306 and an inverter 341 for driving the drum motor 340, and operation, stoppage and rotational frequency thereof are controlled by a unit control portion 342. On the side of the autodoffer 303 is provided a controller 343 formed from a sequencer, and inputted into the controller 343 are signals from a group of proximity switches 345 operated by a predetermined rotational position of the program cam 330 secured to a drive shaft 344, that is, position detection signals from a cam shaft origin sensor PXS1, a bunch winding sensor PXS2, a yarn pickup sensor PXS3, etc. On the other hand, to effect communication between the winding unit 302 and the autodoffer 303, a projector 346 is provided on the autodoffer 303 side and a receiver 347 is provided on the winding unit 302 side. The projector 346 and the receiver 347 are disposed at a position where they are opposed to each other when the autodoffer 303 stops at the winding unit 302.

A signal from the controller 343 on the autodoffer 303 side is communicated in the form of an optical signal from the projector 346 to the receiver 347, and sent to a unit controller 342. At the time of yarn pickup, the drum motor 340 is rotated through an inverter 341. That is, the traverse drum 306 rotates at a low speed, and the package placed in contact therewith is rotated. At that time, a turning shaft 326 is not moved down and rotation of the package 304 by the bunch roller 327 is not carried out, and therefore, no lease disturbance of the bobbin yarn Y occurs. At the time of bunch winding following the yarn pickup, that is, winding of a yarn end on a new bobbin (paper tube), the turning shaft 326 is moved down and the bobbin is rotated by the bunch roller 327 similarly to prior art. In order to prevent an erroneous operation caused by external turbulence (such as sun light) of the receiver 347, the controller 342 as a unit sequencer is designed so that when an input of the receiver is turned ON despite the fact that a bobbin is not full, the traverse drum is not rotated at a low speed even after full-package.

Figure 22:
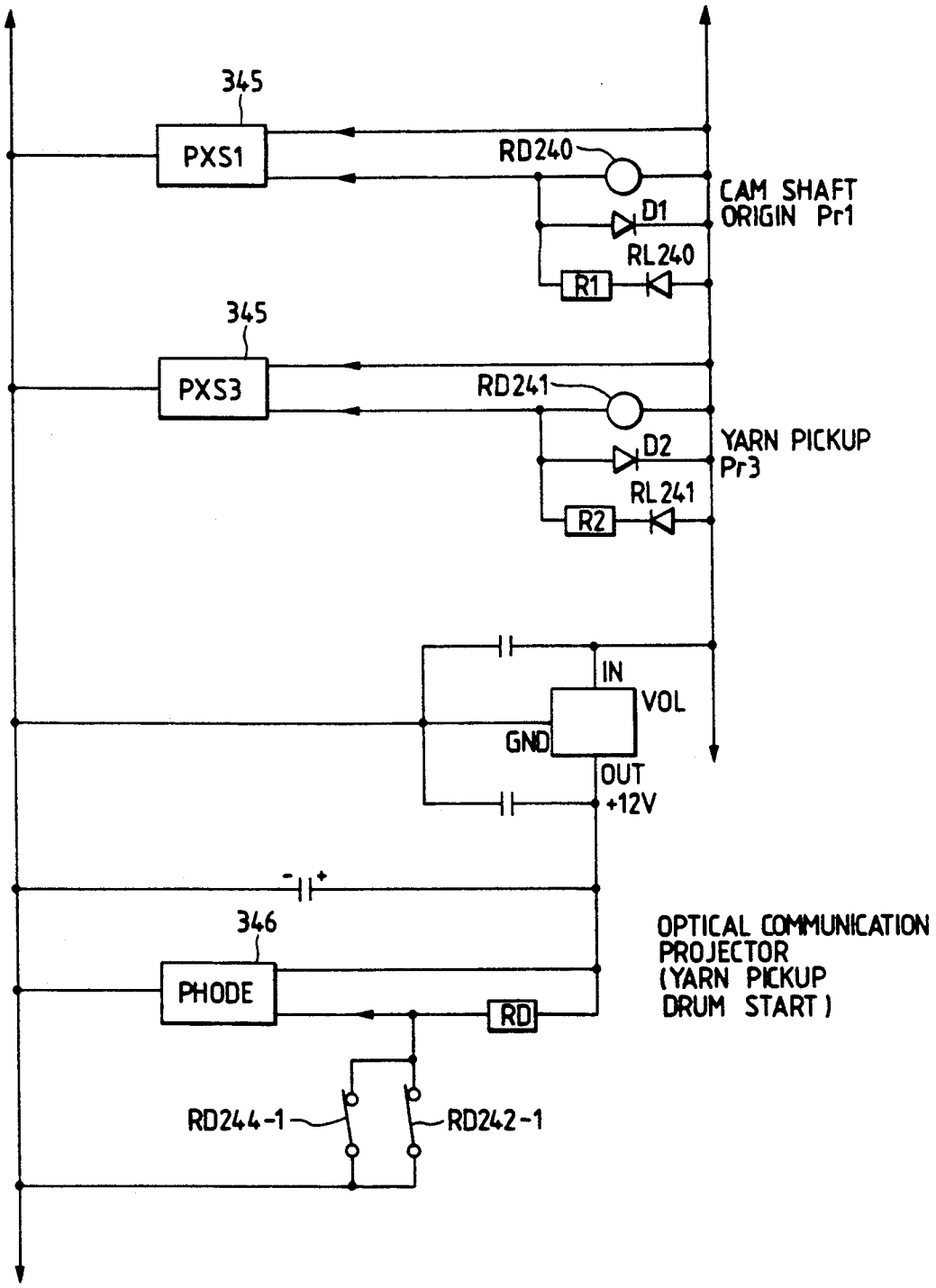
FIG. 22 is a view showing a part of a specific circuit of a controller shown in FIG. 19.
Figure 23:
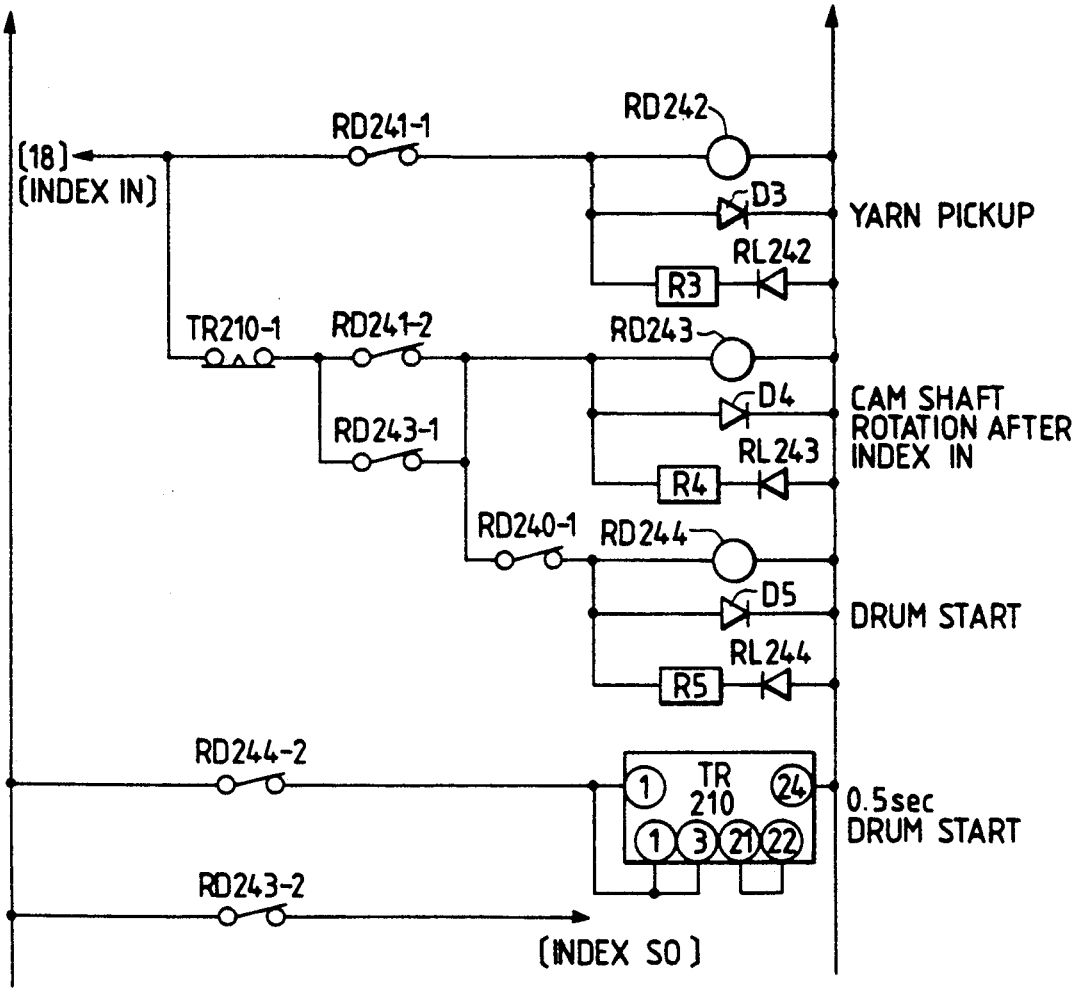
FIG. 23 is a view showing the remaining parts of the specific circuit of the controller shown in FIG. 19.

FIGS. 22 and 23 show an example in which a relay control circuit is used in place of a sequencer as the controller 343 of the autodoffer 303. Among the proximity switches 345 operated by the program cam 330, only the cam shaft origin sensor PXS1 and the yarn pickup sensor PXS3 are shown but the bunch winding sensor PXS2 is not shown in the figure. In FIG. 22, PHODE is the aforementioned projector 346, and the receiver 47 is not shown. In FIG. 23, TR210 is a on-delay timer.

The operation of circuits shown in FIGS. 22 and 23 will be described hereinbelow with reference to a control timing chart of FIG. 24.

When the package 304 is full, a green lamp 48 of the winding unit 302 is lit, and the autodoffer 03 moves to and stops at the winding unit 302. An input of the sequencer controller 342 of the winding unit 302 is normally turned ON, and is turned OFF when the receiver 347 receives light from the projector 346. When an output of the receiver 347 is OFF, an operation display LED (not shown) of the receiver 347 is lit. When the cam shaft is not rotated, that is, when the autodoffer 303 is at the origin position, the cam shaft origin switch PXS1 is turned ON, and a relay RD 240 is excited during that period and its contact RD240-1 (FIG. 23) is turned ON. Accordingly, at a position a in FIG. 24, the RD240 is turned ON. When doffing operation starts and the cam shaft starts to rotate, PXS1 is turned OFF till AD again returns to its origin after termination of one cycle operation, that is, from a to h in FIG. 24, and therefore RD240 is also turned OFF.

First, the rod 322 is raised in a direction as indicated by arrow A in FIG. 21, and the yarn handler arm 331 turns to a position indicated in FIG. 21 to engage the bobbin yarn Y. Next, the program cam 330 assumes a rotation position b in FIG. 24 so that the yarn pickup sensor PXS3 is turned ON and the relay RD 241 is excited. Thereby, the contact RD 241-1 in FIG. 23 is turned ON so that the relay RD 242 is excited, and the contact RD 242-1 is turned ON and the projector 346 is turned ON. A further contact RD 241-2 is turned ON, and a relay RD 243 is excited so that a relay RD 243-1 is turned ON whereby a circuit of cam shaft rotation after index IN is self-retained. At the same time, a further contact RD 243-2 of a cam-shaft rotation circuit after index IN is turned ON so that an index SO is actuated and not moved to another unit even during a period (h to i in FIG. 24) of sending a drum start signal to the unit after the cam shaft has been again returned to the origin.

When upon reception of an optical signal of the projector, an output of the receiver 347 is turned OFF (point b in FIG. 24) and an input of the controller 342 is turned OFF, the controller 342 applies a rotation command of low frequency to an inverter 341 to rotate the drum motor 340 and thus the traverse drum 306 at a low speed. Thereby, the package 304 placed in contact with the traverse drum 306 slowly rotates in a direction of winding the bobbin yarn Y, and the bobbin yarn Y is traversed and slides along the yarn pickup guide 328, the yarn Y being guided to a hole of the pickup 329 at the end. When the bobbin yarn Y is picked up as described above, the rotation of the package 304 is effected not by the bunch roller 327 but by the traverse drum 306. Therefore, no lease disturbance of the bobbin yarn y occurs.

Figure 24:
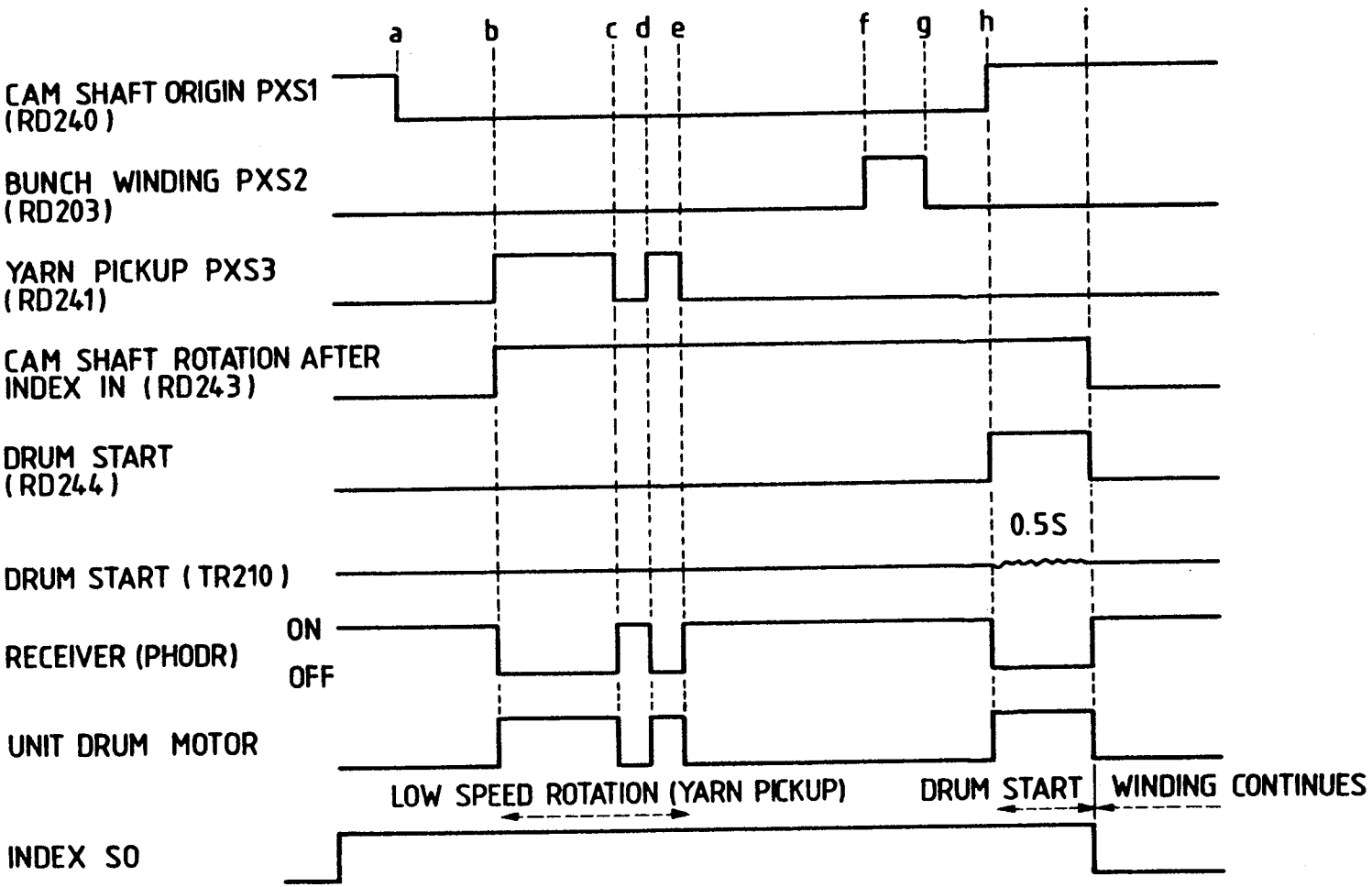
FIG. 24 is a timing chart showing the operation of circuits shown in FIGS. 22 and 23.

Next, as shown in points c, d and e of FIG. 24, the controller 343 of the autodoffer 303 once discontinues an optical signal of the projector 346, adds a shot of pulse at an end of a yarn pickup signal, once stops the motor 340 and then inches it.

In detail, when the yarn pickup sensor PXS3 is once turned OFF and the relay RD 241 is demagnetized, the contacts RD 241-1 and RD 241-2 are turned OFF and the relay RD 242 of the yarn pickup circuit is demagnetized. Thereby, the contact RD 242-1 of FIG. 22 is turned OFF, and an optical signal from the projector 346 is cutoff. That is, an output of the receiver 347 is turned ON (point c of FIG. 24). Then, when the yarn pickup sensor PXS3 is turned ON and the relay RD 241 returns to an excited state, the relay RD 242 of the yarn pickup circuit is excited so that the contact RD 242-1 of FIG. 22 is turned ON to generate an optical signal from the projector 346 and an output of the receiver 347 is turned OFF (point d of FIG. 24). The yarn Y extended between the traverse drum 306 and the full package 304 is cut when the motor stops between c and d. Thereafter, when the yarn pickup sensor PXS3 is turned OFF and the relay RD 241 is demagnetized, an optical signal from the projector 346 disappears (point e in FIG. 24) similar to the case of point c in FIG. 24, and an output of the receiver 347 returns to maintain the ON state. By inching of the motor between d and e, a yarn end hung after being cut is wound on the package 304.

When a rotation position of the program 330 is further advanced to assume f in FIG. 24. the bunch winding sensor PXS2 is turned ON, and a new bobbin is supplied from the autodoffer 303 and set by a circuit not shown. A yarn end of a bobbin yarn is wound on the bobbin, and so-called bunch winding is carried out. The rotation of the bobbin at the time of bunch winding is effected by the bunch roller 327 similar to prior art (between f and g in FIG. 24) since there is no room for occurrence of a problem of lease disturbance like a package.

After termination of the bunch winding, the the cam shaft origin sensor PXS1 is again turned ON (point h in FIG. 24). The relay RD 240 is excited, and the RD 240-1 is turned ON to form a drum start circuit comprising contact TR 210-1, RD 243-1, RD 240-1 and relay RD 244. Because of this, the relay RD 244 is excited, and the contact RD 242-1 is turned ON to generate an optical signal from the projector 346. This optical signal is received by the receiver 347, and the drum motor 330 rotates. On the other hand, at point h in FIG. 24, the contact RD 242-2 (FIG. 23) is turned ON, and the on-delay timer 210 of the drum start circuit is set. This timer TR 210 is actuated (point i) after passage of 0.5 seconds, and the contact TR 210-1 common to the drum start circuit and the index circuit is turned ON to open the circuit (TR 210-1 is normally closed contact b of the time). Thereby, the relay RD 244 of the drum start circuit is demagnetized, and the contact RD 244-1 is again turned OFF so that an optical signal disappears and the drum start signal is turned OFF. The contact RD 244-2 of the drum start circuit of the timer TR 210 is also turned OFF. In the winding unit 302, the drum motor 330 rotates at high speed and winding restarts. In the index circuit, since the relay RD 243 is demagnetized, the contact RD 243-2 is turned OFF and inhibition of movement of the autodoffer 303 is released (index OUT).

As described above, according to the present invention, the rotation of the package when the bobbin yarn is picked up is effected not by the bunch roller as in prior art but by the traverse drum. Therefore, when the bobbin yarn is picked up, it is possible to prevent a damage of a package caused by a bunch roller in prior art. Furthermore, it is possible to positively rotate a package to pick up a bobbin yarn without being affected by the size of package, kinds of yarns, the way of winding, etc.

What is claimed is:

1. A paper tube supply system for supplying a plurality of different types of paper tubes to a winder having a plurality of winding units, the paper tube supply system comprising:

a doffing device for traveling along the plurality of winding units, a plurality of paper tube supply device, each of the plurality of paper tube supply devices being configured to supply a different type of paper tube, at least one of the plurality of paper tube supply devices being configured to supply paper tubes of a first type;

a conveyor for conveying paper tube from each of the plurality of paper tube supply devices to the doffing device, the doffing device comprising a plurality of paper tube holding devices for receiving paper tubes carried by the conveyor, each of the plurality of paper tube holding devices being configured to hold a different type of paper tube, at least one of the plurality of paper tube holding devices being configured to hold paper tubes of the first type, and means for transferring paper tubes of the first type from the supply device for supplying paper tubes of the first type to the holding device for holding paper tubes of the first type.

2. The system of claim 1, wherein the automatic winder defines an end, the plurality of paper tube supply devices are located substantially adjacent the end of the automatic winder, the doffing device defines a travel path, and the conveyor defines a path that is substantially parallel to the travel path defined by the doffing device.

3. The system of claim 1, wherein at least one of the paper tube holding devices comprises:

a guide plate projecting from the doffing device and being in spaced relationship with the conveyor, a take-in arm rotatably supported on the guide plate, a rotary reel provided substantially adjacent the take-in arm, the rotary reel comprising a disk fixedly mounted on a rotatable shaft, the disk defining a circumference, a plurality of rocking plates rockably supported at substantially equally spaced intervals around the circumference at one of the rocking plates and configured to hold a paper tube.

4. The system of claim 1, wherein at least one of the paper tube supply devices comprises:

a paper tube storage portion, a paper tube pull-out portion, and a paper tube delivery portion.

5. The system of claim 4, wherein the paper tube pull-out portion comprises:

a first chuck for holding a plurality of substantially vertically stacked, tapered paper tubes, and a second chuck for holding and lowering the lowermost one of the plurality of substantially vertically stacked, tapered paper tubes, at least one of the first chuck and the second chuck being formed from a ring-like chain which can be reduced in diameter, the chain having a friction member mounted thereon.

* * * * *